US009234337B2

(12) United States Patent
Ball et al.

(10) Patent No.: US 9,234,337 B2
(45) Date of Patent: Jan. 12, 2016

(54) FOOT-ACTUATED DRAIN STOPPER

(71) Applicant: WCM Industries, Inc., Colorado Springs, CO (US)

(72) Inventors: William T. Ball, Colorado Springs, CO (US); Eric Pilarczyk, Colorado Springs, CO (US)

(73) Assignee: WCM INDUSTRIES, INC., Colorado Springs, CO (US)

( * ) Notice: Subject to any disclaimer, the term of this patent is extended or adjusted under 35 U.S.C. 154(b) by 294 days.

(21) Appl. No.: 13/912,421

(22) Filed: Jun. 7, 2013

(65) Prior Publication Data

US 2013/0269100 A1 Oct. 17, 2013

Related U.S. Application Data

(63) Continuation-in-part of application No. 13/274,804, filed on Oct. 17, 2011, now Pat. No. 8,813,272.

(60) Provisional application No. 61/657,434, filed on Jun. 8, 2012, provisional application No. 61/711,333, filed on Oct. 9, 2012, provisional application No. 61/394,611, filed on Oct. 19, 2010, provisional application No. 61/524,675, filed on Aug. 17, 2011.

(51) Int. Cl.

| | |
|---|---|
| ***A47K 1/14*** | (2006.01) |
| ***E03C 1/23*** | (2006.01) |
| ***E03C 1/262*** | (2006.01) |

(52) U.S. Cl.

CPC ... *E03C 1/23* (2013.01); *A47K 1/14* (2013.01); *E03C 1/2306* (2013.01); *E03C 1/262* (2013.01)

(58) Field of Classification Search

CPC ..... A47K 1/14
USPC ..... 4/286–295
See application file for complete search history.

(56) References Cited

U.S. PATENT DOCUMENTS

| | | | |
|---|---|---|---|
| 569,247 | A | 10/1896 | Smith |
| 820,437 | A | 5/1906 | Pehrson |
| 1,592,866 | A | 7/1926 | Murphy |
| 1,805,816 | A | 5/1931 | Fleming |
| 2,190,532 | A | 2/1940 | Lukomski |
| 2,222,807 | A | 11/1940 | Burr |
| 2,278,566 | A | 4/1942 | Schaible |
| 2,323,224 | A | 6/1943 | Kuhnle |
| 2,528,919 | A | 11/1950 | Stone et al. |

(Continued)

FOREIGN PATENT DOCUMENTS

| | | |
|---|---|---|
| CA | 530215 | 9/1956 |
| DE | 419477 | 9/1925 |

(Continued)

OTHER PUBLICATIONS

"Press-In" Trim Kit, AB&A™ IPS Corporation (date unknown) 2 pages.

(Continued)

*Primary Examiner* — Lori Baker
(74) *Attorney, Agent, or Firm* — Sheridan Ross PC

(57) ABSTRACT

A foot-actuated drain stopper is provided that is interconnected to a strainer of a wastewater outlet of a bathtub. The foot-actuated drain stopper is interconnected to the strainer by way of an adapter that includes a hub that receives a carrier on which the foot-actuated stopper travels.

13 Claims, 33 Drawing Sheets

(56) References Cited

U.S. PATENT DOCUMENTS 2,731,649 A * 1/1956 Valentine ..... 4/286
2,736,577 A 2/1956 Mackey
2,890,463 A 6/1959 Young
2,905,951 A 9/1959 Weddendorf, Jr.
2,976,543 A 3/1961 Turner et al.
3,037,212 A 6/1962 Kleinhof
3,046,028 A 7/1962 Nathan
3,048,415 A 8/1962 Shook
3,096,527 A 7/1963 Eynon
3,212,416 A 10/1965 Boersma
3,311,391 A 3/1967 Harrell
3,316,562 A 5/1967 Van Dyke et al.
3,345,085 A 10/1967 Hanes
3,349,412 A 10/1967 Schwartz et al.
3,380,081 A 4/1968 Eilerstson et al.
3,501,172 A 3/1970 Pickard
3,579,670 A 5/1971 Frank
3,615,984 A 10/1971 Chase
3,684,199 A 8/1972 Bebinger
3,800,339 A 4/1974 Bergin
3,813,708 A 6/1974 Hamburg
3,881,201 A 5/1975 Richards
3,911,635 A 10/1975 Traupe
3,982,289 A 9/1976 Robbins
4,059,289 A 11/1977 Morris et al.
4,207,632 A 6/1980 Savell, Jr. et al.
D255,706 S 7/1980 Adam
4,232,407 A 11/1980 Williams
4,257,892 A 3/1981 Boersma
4,310,933 A 1/1982 Stratman
4,320,540 A 3/1982 Leavens
4,329,744 A 5/1982 Cuschera
4,359,788 A 11/1982 Liou
4,412,361 A 11/1983 Cuschera
4,502,166 A 3/1985 Brown, Sr.
4,505,499 A 3/1985 Uglow et al.
4,571,751 A 2/1986 Barlow
4,574,402 A 3/1986 Brown, Sr.
4,594,740 A 6/1986 Tseronakis
4,655,913 A 4/1987 Boersma
4,683,597 A * 8/1987 Taylor et al. ..... 4/295
4,692,948 A 9/1987 Martin
4,706,306 A 11/1987 Smith
4,720,877 A 1/1988 Watts
4,799,713 A 1/1989 Uglow
4,850,617 A 7/1989 Moberly
4,908,883 A * 3/1990 Rivera ..... 4/689
4,926,507 A * 5/1990 Craig et al. ..... 4/689
5,072,461 A * 12/1991 Logsdon ..... 4/295
5,165,118 A 11/1992 Cendrowski
5,265,281 A 11/1993 McAlpine
5,271,108 A 12/1993 Wicke
5,291,619 A 3/1994 Adorjan
5,297,817 A 3/1994 Hodges
5,318,230 A 6/1994 Ferguson et al.
5,330,811 A 7/1994 Buchalter
5,369,815 A 12/1994 Martin
5,372,715 A 12/1994 Maggard et al.
5,376,264 A 12/1994 Betancourt
5,418,983 A 5/1995 Garguillo et al.
5,442,819 A 8/1995 Penor et al.
5,535,455 A 7/1996 Liu
5,560,052 A 10/1996 Ferguson et al.
D379,403 S 5/1997 Jones
5,692,248 A 12/1997 Ball
5,745,931 A 5/1998 Ball
5,758,368 A 6/1998 Ball
5,819,328 A 10/1998 Lewis
D402,354 S 12/1998 Strong et al.
5,881,397 A 3/1999 Hobbs
5,890,241 A 4/1999 Ball
5,924,635 A 7/1999 Koshimizu et al.
5,937,450 A 8/1999 Jones
6,058,526 A 5/2000 Parisi et al.
6,066,119 A 5/2000 Ball
6,067,669 A 5/2000 Peterson et al.
6,070,910 A 6/2000 Hodges
6,085,362 A 7/2000 Huber
6,088,843 A 7/2000 Francisco
6,108,828 A * 8/2000 Cheng ..... 4/287
6,128,788 A * 10/2000 Yamazaki ..... 4/323
6,138,290 A * 10/2000 Lin ..... 4/295
6,148,454 A 11/2000 Ball
6,154,898 A 12/2000 Ball
6,173,459 B1 1/2001 Ball
6,195,819 B1 3/2001 Wang
6,226,806 B1 5/2001 Ball
6,269,495 B1 8/2001 Sondrup
6,317,906 B1 11/2001 Ball
6,332,632 B1 12/2001 Hodges
6,418,570 B1 7/2002 Ball
6,490,739 B1 12/2002 Lee
D475,130 S 5/2003 Stout, Jr.
6,631,623 B1 10/2003 Ball
6,637,050 B1 10/2003 Ball
6,640,358 B2 11/2003 Ball
6,675,406 B2 1/2004 Ball
6,675,407 B1 1/2004 Ball
6,681,420 B1 1/2004 Ball
6,691,411 B2 2/2004 Ball
D488,217 S 4/2004 Stout, Jr.
6,719,294 B2 4/2004 Nguyen et al.
6,735,791 B1 5/2004 Lordahl et al.
6,789,275 B2 9/2004 Spells, Sr. et al.
6,795,987 B2 9/2004 Cornwall
6,799,606 B1 10/2004 Howson
6,800,024 B1 10/2004 Prevost
6,880,179 B2 * 4/2005 Wang ..... 4/295
6,895,838 B2 5/2005 Stahnke
7,013,500 B1 3/2006 Lin
7,055,184 B2 6/2006 Humber
7,127,752 B2 10/2006 Ball
7,188,376 B2 3/2007 Ortiz et al.
7,451,502 B2 11/2008 Ball
7,503,083 B2 3/2009 Ball
7,740,197 B1 6/2010 Schulz
7,814,580 B2 10/2010 Coronado et al.
8,011,030 B2 * 9/2011 Li ..... 4/287
8,347,906 B1 1/2013 Ismert et al.
8,925,123 B2 1/2015 DeGooyer et al.
2002/0023294 A1 2/2002 Spells, Sr.
2003/0025275 A1 2/2003 Miller
2003/0182721 A1 10/2003 Li
2004/0117907 A1 6/2004 Ball
2004/0163165 A1 8/2004 Ortiz et al.
2005/0035558 A1 2/2005 Dipzinski et al.
2005/0050623 A1 3/2005 Greene
2005/0108814 A1 5/2005 Thompson
2006/0170208 A1 8/2006 Arning et al.
2006/0283792 A1 12/2006 McCallum
2007/0039098 A1 2/2007 Ball
2008/0047060 A1 2/2008 Ball
2008/0072387 A1 * 3/2008 Dombrowski ..... 15/105
2008/0098504 A1 * 5/2008 Knox et al. ..... 4/286
2008/0098517 A1 5/2008 Ball
2008/0148469 A1 6/2008 Dipzinski et al.
2008/0196161 A1 8/2008 Ball
2009/0119826 A1 5/2009 Coronado
2009/0172870 A1 * 7/2009 Hong ..... 4/286
2009/0172877 A1 7/2009 Ball
2010/0037392 A1 2/2010 Ball et al.
2011/0035867 A1 2/2011 Coronado et al.
2011/0173747 A1 7/2011 Evans et al.
2011/0209279 A1 9/2011 Ball
2011/0289667 A1 12/2011 Oropallo et al.
2012/0048070 A1 3/2012 Richter
2012/0090084 A1 4/2012 Ball
2012/0110722 A1 * 5/2012 Abbondanzio et al. ..... 4/223
2013/0055494 A1 3/2013 Ball
2013/0067648 A1 3/2013 Whitehead
2013/0193042 A1 8/2013 Hull
2014/0101834 A1 4/2014 Ball
2014/0138297 A1 5/2014 Hull
2014/0325748 A1 11/2014 Ball

(56) References Cited

U.S. PATENT DOCUMENTS

FOREIGN PATENT DOCUMENTS

| | | |
|---|---|---|
| DE | 1784266 | 10/1971 |
| DE | 3621715 | 1/1988 |
| DE | 9200488 | 3/1992 |
| DE | 4206903 | 9/1993 |
| DE | 20118252 | 3/2003 |
| GB | 1216285 | 12/1970 |
| JP | S53-58752 | 5/1978 |
| JP | H05-15887 | 3/1993 |
| JP | H05-88393 | 12/1993 |
| JP | H09-108130 | 4/1997 |
| JP | 2000-513421 | 10/2000 |
| JP | 2003-313913 | 11/2003 |
| WO | WO 99/54560 | 10/1999 |
| WO | WO 02/063109 | 8/2002 |
| WO | WO 2004/074587 | 9/2004 |
| WO | WO 2009/063334 | 5/2009 |
| WO | WO 2013/112560 | 8/2013 |

OTHER PUBLICATIONS

Complaint for Delaratory Relief (with Exhibits 1-7), *IPS Corporation* v. *WCM Industries, Inc.*, United States District Court for the Western District of Tennessee, Case No. 2:12-cv-02694, filed Aug. 9, 2012, 58 pages.

Defendant WCM Industries, Inc's Answer to Complaint, Affirmative Defenses and Counterclaims Against IPS Corporation, *IPS Corporation* & *WCM Industries, Inc.*, United States District Court for the Western District of Tennessee, Case No. 2:12-cv-02694-JPM-tmp, filed Apr. 12, 2013, 10 pages.

Plaintiff IPS Corporation's Answer to Defendant WCM Industries, Inc's Counterclaims, *IPS Corporation* v. *WCM Industries, Inc.*, United States District Court for the Western District of Tennessee, Case No. 2:12-cv-02694-JPM-tmp, filed May 3, 2013, 5 pages.

IPS Corporation's Initial Non-Infringement Contentions (with Exhibit A), *IPS Corporation* v. *WCM Industries, Inc.*, United States District Court for the Western District of Tennessee, Case No. 2:12-cv-02694-JPM-dkv, dated Jun. 7, 2013, 5 pages.

Plaintiff IPS's Initial Invalidity Contentions (with Exhibits A and B), *IPS Corporation* v. *WCM Industries, Inc.*, United States District Court for the Western District of Tennessee, Case No. 2:12-cv-02694-JPM-dkv, dated Aug. 6, 2013, 78 pages.

Examination and Search Report for United Kingdom Patent Application No. GB1118043.7, dated Oct. 31, 2011 6 pages.

Examiner's Report for Canadian Application No. 2,556,523, dated Feb. 16, 2009.

Notice of Allowance for U.S. Appl. No. 11/161,933, mailed Jan. 29, 2009.

Official Action for U.S. Appl. No. 11/161,933, mailed Jun. 23, 2008.

Official Action for U.S. Appl. No. 12/405,956, mailed Oct. 14, 2010.

Official Action for U.S. Appl. No. 13/041,929 mailed Dec. 18, 2013, 6 pages.

Official Action for U.S. Appl. No. 13/669,417 mailed Mar. 1, 2013, 7 pages.

Notice of Allowance for U.S. Appl. No. 13/669,417 mailed Sep. 27, 2013, 9 pages.

Official Action (with partial English summary) for Mexican Patent Application No. MX/a/2012/002782 dated Dec. 1, 2014, 3 pages.

Final Action for U.S. Appl. No. 14/109,503, mailed Dec. 29, 2014, 10 pages.

Official Action for U.S. Appl. No. 13/274,804 mailed Dec. 24, 2013, 10 pages.

Notice of Allowance for U.S. Appl. No. 13/274,804 mailed Apr. 23, 2014, 6 pages.

Official Action for U.S. Appl. No. 13/041,929 mailed May 8, 2014, 12 pages.

"OATEYSCS Supply Chain Services Catalog," Oatey Co., 2012, 334 pages.

"Push N' Repair Closet Flange," IPS Corporation, 2011, [retrieved Sep. 6, 2014], 1 page. Retrieved from: http://web.archive.org/web/20111013024522/http://ipscorp.com/watertite/closetflanges/pushnrepair.

Official Action for U.S. Appl. No. 14/109,503 mailed Aug. 18, 2014, 6 pages.

Notice of Allowance for U.S. Appl. No. 13/041,929 mailed Feb. 11, 2015, 7 pages.

Notice of Allowance for U.S. Appl. No. 14/109,503, mailed Mar. 11, 2015 8 pages.

* cited by examiner

FOOT-ACTUATED DRAIN STOPPER

This application claims the benefit of U.S. Provisional Patent Application Ser. No. 61/657,434, filed Jun. 8, 2012, and U.S. Provisional Patent Application Ser. No. 61/711,333, filed Oct. 9, 2012, the entire disclosure of which are incorporated by reference herein.

This application is also a continuation-in-part of U.S. patent application Ser. No. 13/274,804, filed Oct. 17, 2011, which claims the benefit of U.S. Provisional Patent Application Ser. Nos. 61/394,611, filed Oct. 19, 2010, and 61/524,675, filed Aug. 17, 2011, the entire disclosures of which are incorporated by reference herein.

FIELD OF THE INVENTION

Embodiments of the present invention are generally related to drain closure valves, i.e., "stoppers," that are used to selectively block a drain port of a fluid reservoir. More specifically, one embodiment of the present invention is a foot-actuated drain stopper associated with a strainer positioned in a bathtub drain port.

BACKGROUND OF THE INVENTION

Water receptacles, such as bathtubs, generally include a drain port located at their lowermost point. The drain port feeds waste water to a drain pipe and accommodates a strainer that prevents items from entering the drain pipe. Thus, a "strainer" as understood by one of skill in the art, is a fitting located in the bottom of a sink, bathtub, or the like (hereinafter "bathtub") that is interconnected to the drain pipe. Commonly, a strainer includes a cylindrical body portion with external threads that engage corresponding threads of the drain port and/or the drain pipe. Strainers also include a flange extending from an upper end of the strainer body that engages the bottom surface of the bathtub. The bottom surface of some bathtubs have an indentation that receives the flange so that the top surface of the flange is generally flush with the bottom surface of the bathtub. Many strainer bodies accommodate drain closure valves that selectively control the flow of water out of the bathtub. The closure valve is often interconnected to the strainer by way of a carrier that extends upwardly from a hub located within the strainer body. The distance between the flange and the hub varies depending on the type of strainer body and closure valve employed.

Strainer flanges may become outdated, damaged, or marred. In addition, individuals may simply wish to change the look and feel of their bathroom by changing the plumbing fixtures. For example, one may wish to replace brushed-nickel fixtures to brass fixtures. Replacement, however, is often very difficult because the strainer must be disconnected from the drain pipe, which is difficult to access because it is often located beneath the floor to which the bathtub is interconnected. Further, the threads of the replacement strainer may not be compatible with the threads of the drain port and/or drain pipe.

Wastewater strainers are presently concealed by devices that are glued to or otherwise interconnected to the wastewater strainer or the flange thereof. That is, instead of replacing the wastewater strainer, a concealing member of the intended finish is placed on the flange of the existing strainer. For example, attention is directed to Applicant's Nufit™ device, which is disclosed in U.S. Pat. No. 5,745,931, that employs a flange that is glued onto the strainer flange. The Nufit™ flange includes a downwardly-extending outer lip that engages an outer edge of the wastewater strainer flange that, alone or in concert with other features, helps maintain radial position of the Nufit™ device in relation to the strainer body. The Nufit™ device also employs a cylindrical portion that is placed within the strainer body.

Another concealing device is described in U.S. Pat. No. 7,503,083 (the "'083 patent") that is similar to that of the Nufit™ device wherein a flange is provided with a cylindrical portion extending therefrom. The cylindrical portion also includes at least one groove for receiving an o-ring seal that engages the strainer body to maintain the position of the concealing device. The o-ring seal helps align the opening of the strainer and the concealing device. It should be noted that the device of the '083 patent contemplates a system wherein no adhesives are used. The outer edge of the '083 device may also include a downwardly extending outer lip for engaging the outer edge of the waste water flange similar to that described above.

One drawback of the prior art concealing devices is that the downwardly-extending cylindrical portion often employed may interfere with internal components of the strainer body which can potentially prevent engagement of the concealing device onto the strainer flange. Additionally, strainer bodies usually possess spokes or cross members that accommodate the hub that holds the closure valve carrier that could interfere with the proper placement of the concealing device. Further, there are a multitude of strainer manufacturers, each with different designs, sizes, features, etc., which makes integrating a concealing device difficult. In addition, manufacturers may, over time, modify designs such that retrofitting existing strainers may prove problematic. The interference between the concealing device and the strainer frustrates consumers and forces them to either alter the cylindrical portion of the concealing device, i.e., trim it, or to purchase a new one. As trivial as this may at first appear, the practical consequences of such difficulties has serious financial implications. For example, a $500 per night hotel room may remain vacant simply due to the inability to conceal damaged bathtub fixtures. The foreseeable cost caused by the failure to have a straightforward "one size fits all" solution is enormous and orders of magnitude above the cost of the product itself Drain valves commonly comprise a cap with an interconnected seal. The cap and seal are sometimes interconnected to a downwardly-extending post that slidingly engages an upwardly-extending carrier that is interconnected to the hub of a strainer body. Operation of this type of drain valve comprises pulling the cap upwardly which removes the seal from the strainer body flange. To close the drain valve, the cap is pushed downwardly to engage the seal onto the strainer body flange. Some drain valves also include posts/carriers that include or receive selectively-deflectable pins or seals, for example, to maintain the open position of the cap. Such a system is disclosed in U.S. Pat. No. 6,418,570, the entirety of which is incorporated by reference herein.

Other drain valves of this type have a post with a groove that receives a complimentary portion of the carrier, or vice versa. To maintain the drain stopper in an open configuration, the cap must be twisted or turned about the longitudinal axis of the post which seats the complimentary portion in the groove in such a way to prevent closure of the valve. To close the drain valve, the cap is again turned to unseat the complimentary portion to allow the post to slide relative to the carrier.

One drawback of the drain stoppers of this embodiment is that the post and carrier must extend into the strainer body, which obstructs fluid flow. More relevant, perhaps, is that the post and carrier make retrofitting a new drain valve onto an existing or new strainer body difficult. More specifically, when adding a new drain valve onto an existing or new strainer body, the old drain valve must be removed from the hub, which could damage the hub. Further, the new carrier or post may be too long, too short, or there may be some incompatability between the carrier, post, or hub.

These issues were addressed in the past by providing closure valves that did not require a carrier. More specifically, drain valves that are rotatably interconnected to the edge of a strainer body, as taught by U.S. Pat. No. 5,758,368, which is incorporated by reference herein, do not extend into the strainer body when the valve is closed. The drawbacks for this type of drain valve are that one needs to put their hand into dirty water to open the valve. Of course, users could use their foot, but the size of these drain valves make it difficult for some users.

Thus, it has been a long felt but unsolved need to provide a drain valve closure that is easy to install and can accommodate various models of wastewater strainer bodies. Further, it is a need to provide a drain valve that is easy to use and access with one's foot.

SUMMARY OF THE INVENTION

It is one aspect of the present invention to provide a device for concealing at least a portion of a wastewater strainer that is associated with a drain port of a bathtub. One embodiment of the present invention includes a plate with an aperture therethrough and an outer edge that generally coincides with an outer edge of the strainer body flange. The plate can be any thickness and made of any material so long as it conceals at least a portion, and more preferably the majority of a flange of the wastewater strainer. One embodiment of the present invention is about 0.020 inches thick. Some plates of embodiments of the present invention possess a downwardly extending outer lip that engages an outer edge of a strainer body flange to maintain the plate alignment with respect to the wastewater strainer flange.

Certain embodiments of the present invention generally have no portion that extends into the wastewater strainer, thereby making them suitable for use with all types of existing strainers. Some embodiments, however, have portions that extend into the strainer to such a degree to not affect interconnection of the concealing device to the strainer. For example, a series of spaced tabs may be selectively interconnected adjacent to the inner diameter of the plate that defines an aperture for receiving fluid. The tabs extend into the strainer body similar to inserts of the prior art. The tabs are spaced such that the cross members of the strainer body that support a carrier-receiving hub are received in the spaces between adjacent tabs, thereby allowing the device to accommodate strainer bodies of various types. One of skill in the art will appreciate that the tabs may be frangible to decrease the length thereof, if needed, or completely removable from the plate. The tabs of some embodiments extend 2 centimeters from the plate, 1 cm from the plate, or 0.5 cm from the plate. The tabs may also be made to split longitudinally to decrease the width thereof and to increase the gap between adjacent tabs.

Other embodiments enhance alignment of the concealing device with the strainer body by providing a flexible or compressible screen segment interconnected to the plate that extends into the strainer body. The screen will compress when contacting the cross members and may also include a plurality of openings that allow fluid flow through the walls thereof. The flexible material may also be cut to accommodate strainers of various sizes.

Similarly, the plate may employ additional features to enhance alignment. For example, a series of grooves or small projections may extend from the underside of the plate to help align the plate on strainer body flanges of various diameters.

It is thus another aspect of the present invention to provide a device for concealing a strainer body wherein substantially no portion of the device is located within the strainer body. To accommodate a drain valve, one embodiment of the present invention includes a plurality of arms that extend into an opening of the plate. The arms terminate at a hub that accommodates the carrier that extends above the plate. Lift and turn mechanisms as taught by U.S. Pat. No. 5,758,368, Presflo™ stopper mechanism, as taught by U.S. Pat. No. 6,066,119; and push/pull stoppers as taught by U.S. Pat. No. 6,418,570, may be used with embodiments of the present invention, these patents are incorporated by reference in their entirety herein. One of skill in the art will appreciate that the arms of the device may be omitted where, for example, the drain valve is operably interconnected to a carrier traditionally associated with the strainer body.

It is another aspect of the present invention to provide a device and method for concealing a wastewater strainer that employs an adapter that is selectively interconnectable to the plate. The adapter is interconnected to the plate, preferably, to the arms thereof, and is designed to extend downwardly into the wastewater strainer. This embodiment will provide greater stability between the plate and the wastewater strainer. It is contemplated that the adapter will accommodate strainers of various sizes or correspond to a specific strainer. The adapter of one embodiment of the present invention also includes at least one groove for receiving an o-ring that helps interconnect the adapter to the strainer body. It is also contemplated that the device for concealing may be sold or accompanied by with the adapter wherein if an interference exists between the adapter and the strainer body, the adapter could be removed.

In operation of one embodiment, the plate is superimposed over the flange of a conventional strainer body located in the bathtub. If present, the downwardly extending edge associated with the outer edge of the plate is used to align the plate on to the flange of the strainer body. Other embodiments of the present invention have alternative physical features for contacting the outer edge of the strainer body flange. Such contacting portions may be grooves that correspond to and engage with the outer edge of the strainer flange.

An adhesive may be placed between the plate and the strainer body flange and provides one, if not the sole, means of fixing the plate to the strainer body flange. The bottom portion of the plate may include a roughened or otherwise non-continuous surface to help facilitate adhesive binding. The roughened surface may include text or other indicia to identify the origin of the product.

Alternatively, the plate may include adhesive and associated substrate incorporated onto its lower surface. In operation, an installer would remove the substrate to expose the associated adhesive that bonds the concealing member to the strainer body flange. To facilitate bonding, the adhesive may be heat sensitive wherein exposure of hot water will initiate cure and create a permanent bond between the plate and the strainer body flange. One skilled in the art will appreciate that magnets may also be employed to interconnect the plate to the strainer body. In this example, the strainer body flange may receive a ferromagnetic material that would selectively bond with a magnet associated with the concealing device.

It is one aspect to provide a drain stopper that is low profile. More specifically, in one embodiment of the present invention the carrier extends upwardly from the plate wherein no portion extends into the strainer body. In this example, the drain stopper includes a cavity that receives the carrier. In operation, the carrier has an upper end that includes a ring that is received by a complimentary groove in the stopper cavity when the drain valve is pulled upwardly to an open position. That is, the ring will seat in the groove to maintain the drain valve in the open position. When the drain valve is pushed down, the ring is forceably removed from the groove and the carrier is received within the drain stopper so that the seal can be engaged onto the plate.

To facilitate use of this type of a drain stopper with one's foot, the drain stopper is spring-biased in the open position, which will be described in further detail below. In another embodiment, a foot-actuated drain stopper is provided that uses a ring that cooperates with a rotatable carrier. The ring includes a detent that is received within a groove or guide path of the carrier. As the drain stopper moves relative to the plate, the ring's detent moves in the groove which rotates the carrier. Eventually, the seal will contact the plate to close the valve, and at that point the ring detent will be captured within the groove and will prevent the cap from moving upwardly. To maintain the position of the cap relative to the plate, a spring is positioned within the carrier which urges the cap upwardly to firmly seat the detent in a capture point in the groove. To open the valve, additional downward force is applied to the cap which forces the ring detent downward further to rotate the carrier which provides access to an obstruction-free portion in the groove for which the detent can travel.

One of skill in the art will appreciate that the carriers as described herein can be used with traditional strainers. More specifically, the carriers of embodiments of the present invention may be incorporated on an existing strainer body hub by way of a threaded adapter. Such adapter may have threaded interfaces of various diameters to coincide with various hubs. One side of the adapter would be used to interconnect with the hub and another side to the carrier. In addition, the adapter can be comprised of a plurality of sub-components wherein different lengths and/or diameters are used to receive carriers and hubs of various manufacture.

It is one aspect of embodiments of the present invention to provide a foot-actuated drain stopper, comprising: a cap; a seal associated with said cap; an adapter comprising: a body having at least one groove, a flange extending from said body, at least one arm interconnected to at least one of said body and said flange; a carrier interconnected to said hub, and a hub interconnected to said at least one arm and located generally in the center of the body; wherein said adapter is adapted for insertion into a strainer that is associated with a drain port of a bathtub; and wherein said cap is capable of a first position of use that spaces the seal away from a flange of the strainer and a second position of use that engages the seal onto the flange of the strainer.

It is yet another aspect of embodiments of the present invention to provide a foot-actuated drain stopper adapted for interconnection to a strainer having a flange and a hub, comprising: a cap; a stopper body associated with said cap; a seal interconnected to said cap; a carrier associated with said hub; a ring operably associated with at least one of said cap and said stopper body, wherein said carrier is rotatably interconnected to said ring, said carrier having a groove in its outer surface and said ring having an inwardly-extending detent that is operably received within said groove wherein movement of said ring along the length of the carrier causes at least one of said ring and said carrier to rotate; and wherein said cap is capable of a first position of use that spaces the seal away from a flange of the strainer and a second position of use that engages the seal onto the flange of the strainer.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
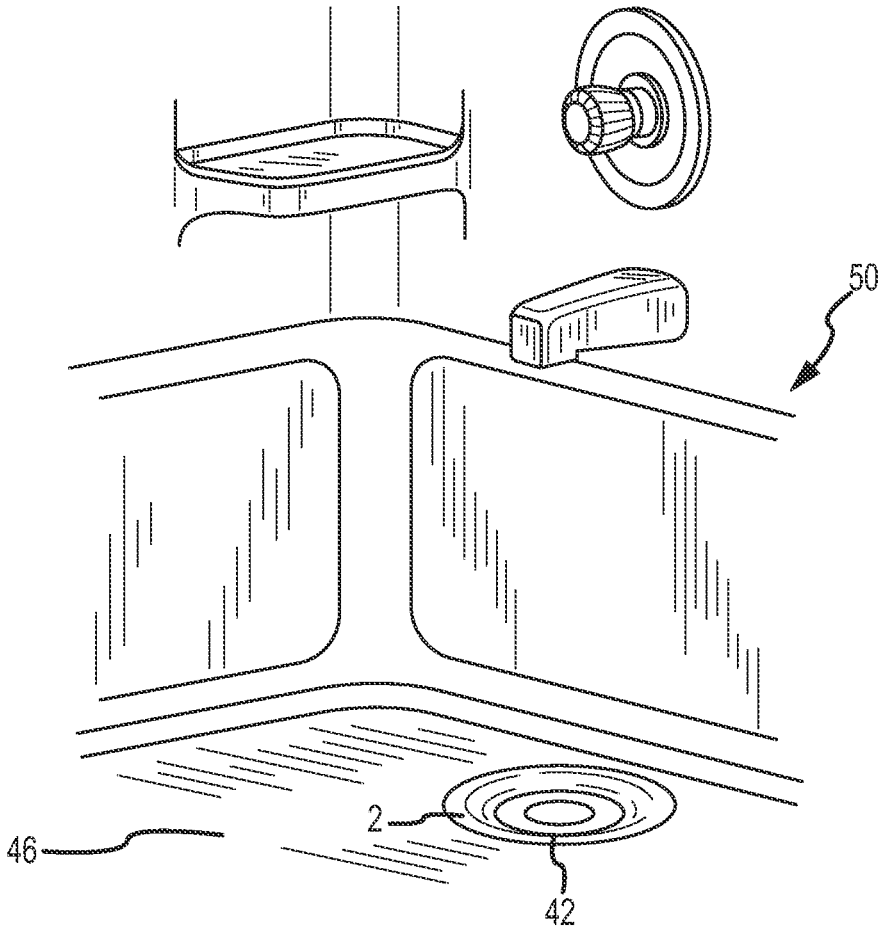
FIG. 1 is a perspective view of a wastewater strainer positioned in a bathtub.

To assist in the understanding of one embodiment of the present invention the following list of components and associated numbering found in the drawings is provided herein:

| # | Component |
|---|---|
| 2 | Concealing device |
| 6 | Plate |
| 10 | Opening |
| 14 | Arms |
| 18 | Hub |
| 22 | Carrier |
| 26 | Stopper |
| 30 | Outer edge |
| 34 | Outer edge |
| 38 | Flange |
| 42 | Wastewater strainer |
| 46 | Bottom surface |
| 50 | Bathtub |
| 54 | Lip |
| 62 | Opening |
| 64 | Sealant |
| 66 | Stopper body |
| 70 | Seal |
| 74 | Knob |
| 78 | Cavity |
| 82 | Adapter |
| 86 | Seal groove |
| 90 | Clip |
| 94 | Conduit |
| 98 | Tape |
| 102 | Ring |
| 106 | Adhesive sheet |
| 110 | Tabs |
| 114 | Score line |
| 118 | Bellows |
| 122 | Stopper |
| 126 | Chain |
| 130 | PEM insert |
| 134 | Centering dome |
| 138 | Carrier |
| 142 | Rotatable carrier |
| 160 | Detent |
| 144 | Guide path |
| 146 | Stopper body |
| 150 | Seal |
| 154 | Friction ring |
| 158 | Ring |
| 162 | Screw |
| 164 | Cap |
| 168 | Spring |
| 170 | Capture portion |
| 174 | Connector |
| 178 | Bolt |
| 182 | First end |
| 186 | Second end |
| 190 | Hub |
| 194 | Spokes |
| 200 | Adapter |
| 300 | Carrier |
| 304 | Adapter |
| 308 | First portion |
| 312 | Second portion |
| 316 | Groove |
| 320 | Tapped hole |
| 324 | First portion |
| 328 | Second portion |
| 400 | Foot-actuated stopper |
| 404 | Strainer body |
| 408 | Adapter |
| 412 | Groove |
| 416 | O-Ring |
| 420 | Inner wall |
| 424 | Hub |
| 428 | Arm |
| 432 | Carrier |
| 436 | Screw |
| 440 | Lip |
| 444 | Strainer body flange |
| 448 | Seal |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-12, a wastewater strainer concealing device 2 of one embodiment of the present invention is shown. The concealing device 2 is generally comprised of a plate 6 with an opening 10 therethrough. A plurality of arms 14 is associated with the plate 6 that extend into the opening 10 and terminate at a hub 18. Although two arms are shown, one of skill in the art will appreciate that one or more arms may be provided. The hub 18 in turn accommodates an upwardly extending carrier 22 that operably receives a drain stopper 26. The hub 18 of one embodiment of the present invention includes a threaded portion that receives a threaded end of the carrier 22. For example, the hub 18 may be comprised of internally threaded fastener that is pressed into the surrounding metal, e.g., a PEM® Nut manufactured by Penn Engineering and Manufacturing Corp. Alternatively, the threads may be machined into the plate 6 or the carrier 22 may be permanently integrated onto the plate. Still further, the carrier 22 may be interconnected to the hub 18 by a nut that is received onto a portion of the carrier 22 that extends through the plate. The plate 6 is preferably circular and has an outer edge 30 that corresponds with an outer edge 34 of a flange 38 associated with the wastewater strainer 42 that is engaged to a bottom surface 46 of the bathtub 50. The opening 10 may be a series of openings similar to a grate. Further, the opening 10 or openings may be of any shape. In one embodiment of the present invention, the plate 6 is about 1/32 inch thick, has an outer diameter of about 3 inches, and has an opening having a diameter of about 1 7/16 inches.

The plate 6 of the concealing device 2 may include a downwardly-extending lip 54 or a plurality of members, e.g., tabs, that engage the outer edge 34 of the strainer flange 38 to ensure that the drain opening 62 is unobstructed.

The plate 6 of one embodiment of the invention is adapted to receive logos and laminates and be any color. The plate 6 is preferably made of a metallic material, but other materials, such as plastic may be employed. Further, temperature sensitive materials that provide a visual indication of water temperature may be employed, which is important when bathing children. The plate 6 may include temperature sensitive portions in the form of letters or logos as well.

In operation, the flange 38 of the wastewater strainer 42 and/or the underside of the plate 6 is applied with adhesive 64 or an adhesive tape. The plate 6 is then affixed to the flange 38 wherein the opening 10 of the plate is aligned with the opening 62 of the wastewater strainer. The stopper 26 is then associated with the carrier 22. As one of skill in the art will appreciate, the plate 6 may be interconnected to the wastewater strainer 42 without an adhesive wherein the hub 18 of the plate 6 is interconnected to the hub of the wastewater strainer 42 (not shown) by way of a connecting member, e.g., a threaded rod (See FIGS. 40 and 41, for example). The connecting member may be integral with the carrier 22. Further, the connecting member may be capable of interconnecting to wastewater strainers of various sizes and manufacture.

Figure 6:
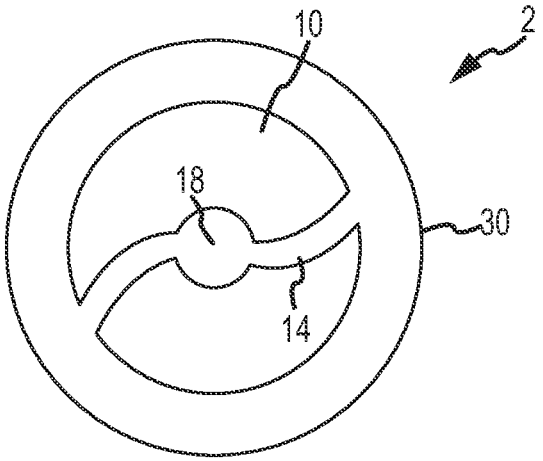
FIG. 6 is a top plan view of another embodiment of the present invention.
Figure 7:
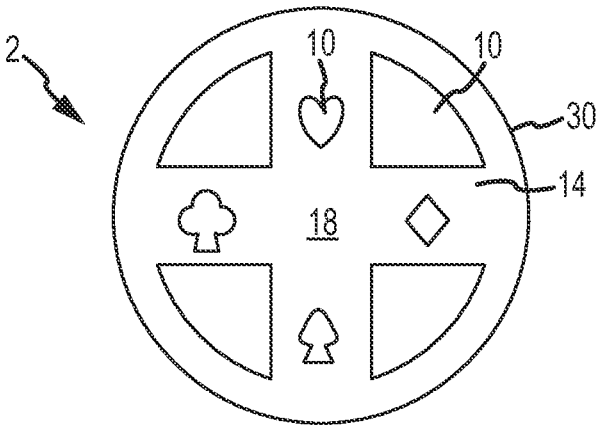
FIG. 7 is a top plan view of another embodiment of the present invention.
Figure 8:
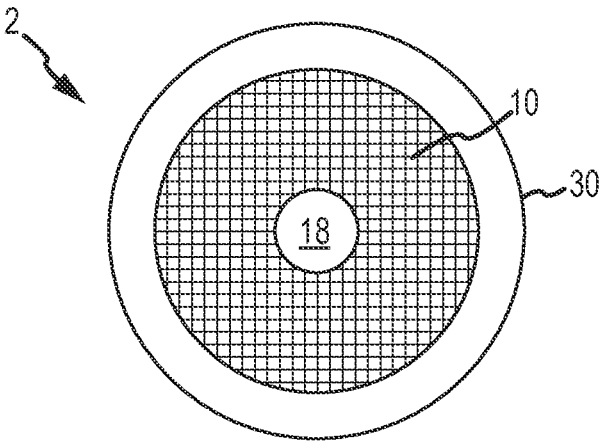
FIG. 8 is a top plan view of another embodiment of the present invention.
Figure 9:
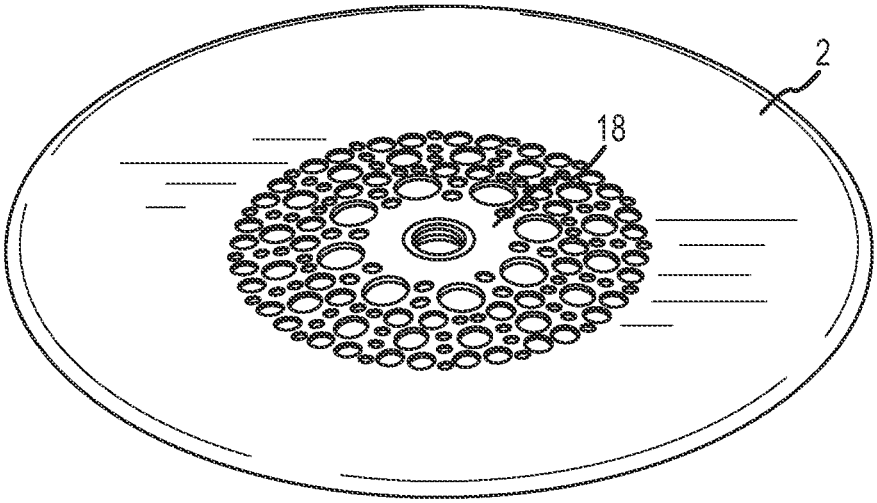
FIG. 9 is a top perspective view of another embodiment of the present invention similar to FIG. 8.
Figure 10:
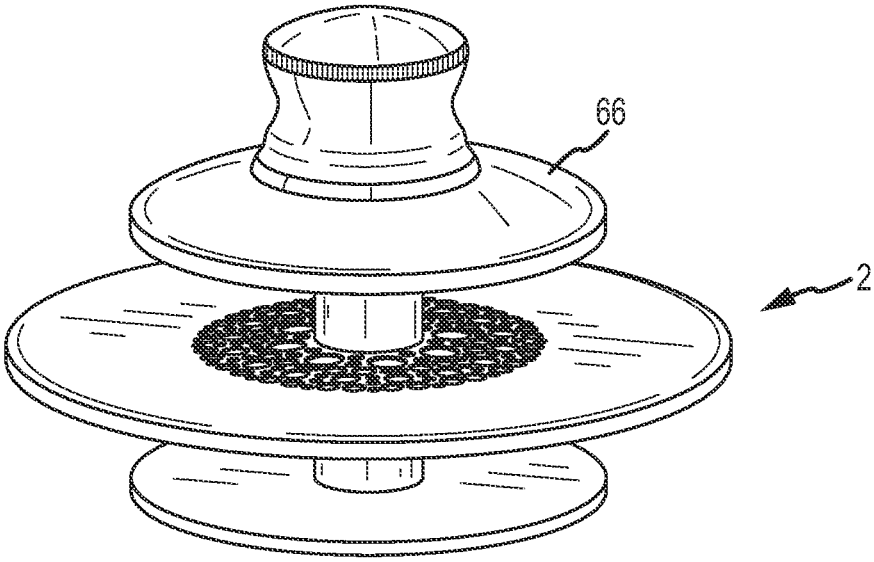
FIG. 10 is a front perspective of the embodiment shown in FIG. 9 shown in conjunction with a stopper.

Referring now to FIGS. 3-10, plates 6 of various styles are provided. As will be appreciated by those in the art, the plate 6 may include openings 10 of various sizes and configurations. Similarly, the arms 14 of any number may be employed. For example, in FIG. 3, three arms 14 are provided while in FIG. 4, four arms 14 are provided. The arms may be symmetrical or may be non-symmetrical, as shown in FIG. 6. Furthermore, the arms may include designs or openings of various shapes as contemplated by FIG. 7. Those skilled in the art will appreciate that the opening may be comprised of a grate as shown in FIGS. 8-10 wherein the hub 18 is located thereon.

Those skilled in the art will also appreciate that the outer edge 30 and edges associated with the openings 10 may be beveled to create a sloped interface between the top surface of the plate 6 and the bottom of the bathtub floor. The outer diameter of the outer edge 30 may be smaller, but is preferably equal to or larger than the diameter of the existing wastewater strainer flange to which it will be interconnected. Those skilled in the art will appreciate that larger diameters may be needed in order to fully conceal the drain port of a bathtub and associated strainer. The plate 6 may have various finishes as described herein. Furthermore, the arms 14 and/or hub 18 may have finishes that are different from the other portions of the plate 6.

Figure 11:
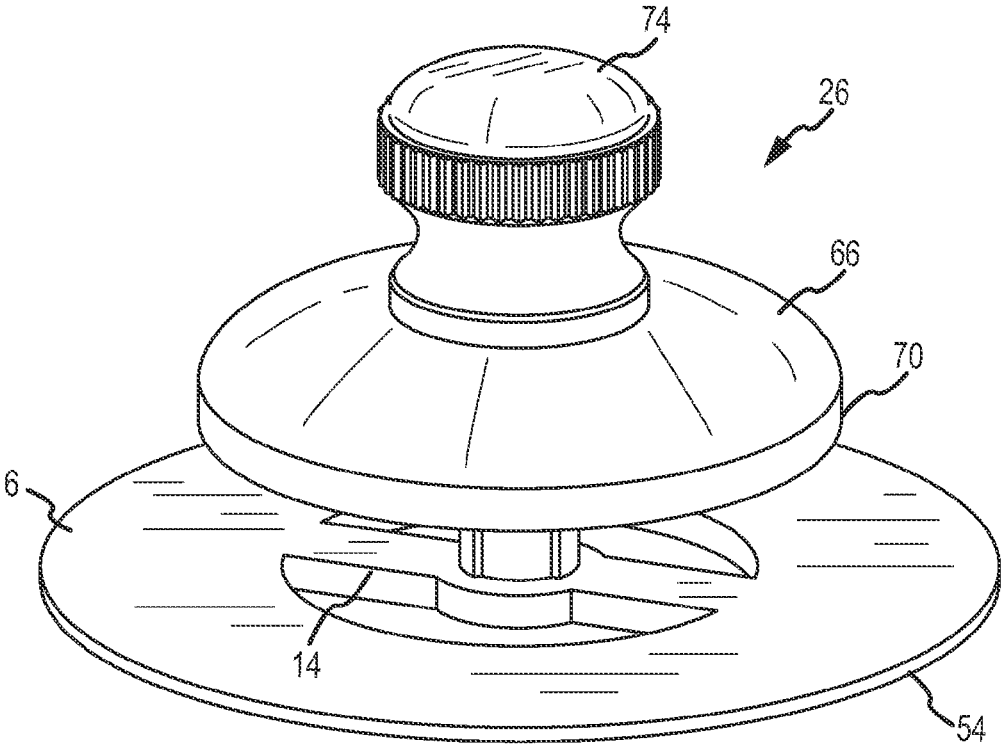
FIG. 11 is a perspective view of FIG. 2 with an associated stopper.
Figure 12:
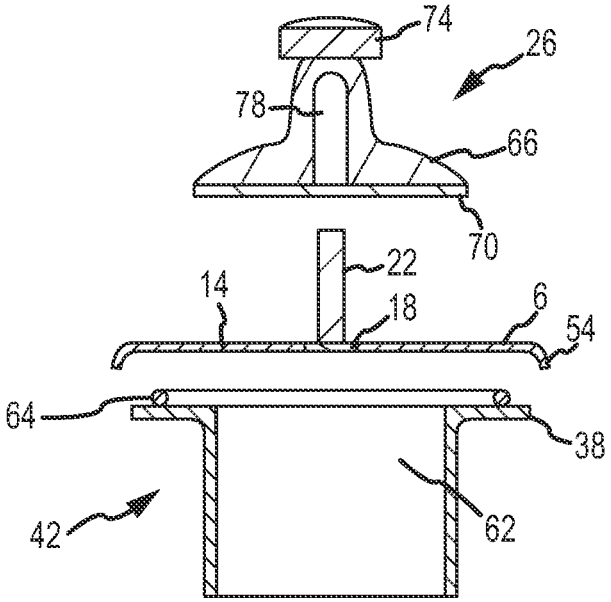
FIG. 12 is a cross-sectional view of FIG. 11 positioned adjacent to a wastewater strainer.

FIGS. 11 and 12 show the carrier 22 that is adapted to receive a drain closure valve, i.e., a "stopper." Stoppers 26 are commonly comprised of a stopper body 66 with interconnected seal 70 that cooperates with the plate 6 to prevent fluid flow through the opening 10 in the plate and the opening 62 in the strainer flange. The stopper 26 may include a knob 74 and includes a cavity 78 for receipt of the carrier 22 such that generally no portion of the stopper 26 or concealing device 2 penetrates into the strainer 42. As discussed above, the stopper 26 may be lift and turn, Presflo™, push/pull, foot-actuated, solenoid actuated, or any other type of stoppers commonly employed. The stopper and associated knob may include a feature that prevents the stopper from completely separating from the carrier. Such feature is found, for example, in U.S. Pat. No. 5,758,368.

Figure 13:
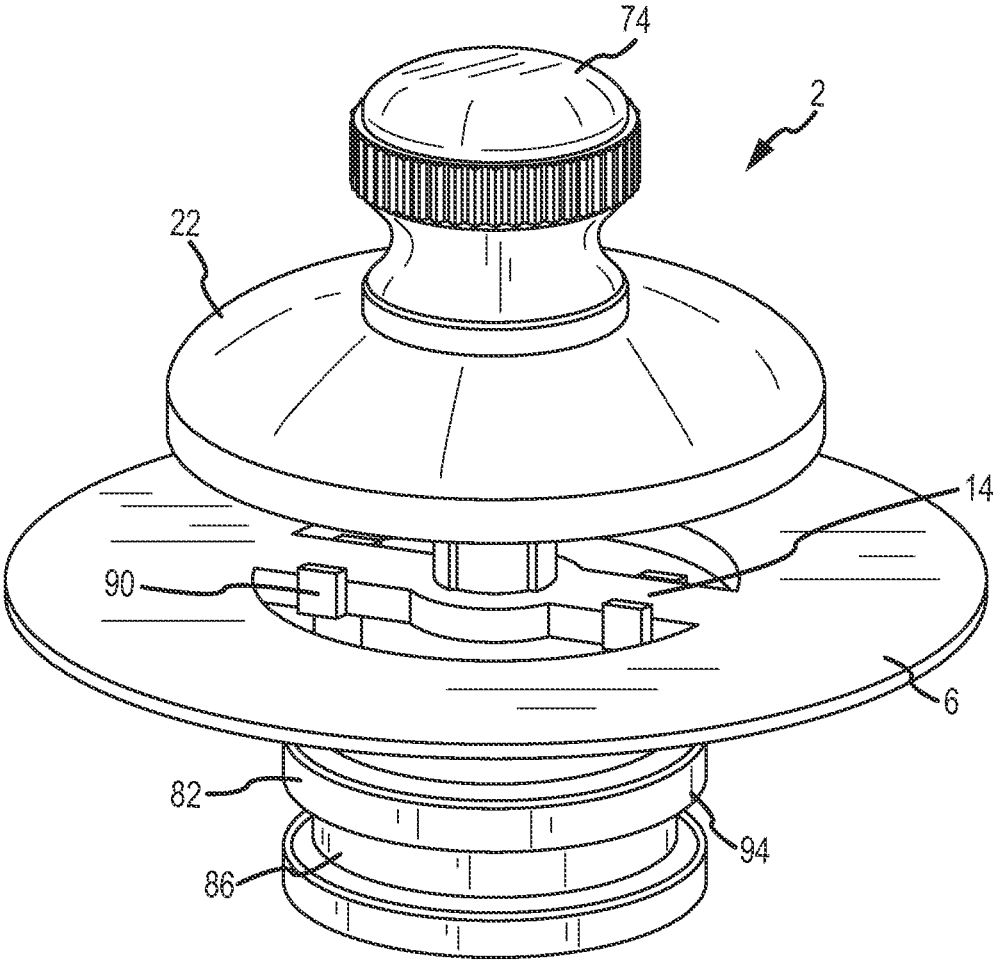
FIG. 13 is a front elevation view of a waste water concealing device of another embodiment of the present invention that employs an adapter for insertion into the wastewater strainer.

Referring now to FIG. 13, another embodiment of the present invention is shown that includes an adapter 82 that is associated with the plate 6. The adapter 82 is a cylindrical portion that includes at least one seal groove 86 for receiving an o-ring (not shown). In operation, the o-ring, plugs, a fitted seal, etc., engages the adapter to an inner wall of the strainer body to secure the concealing device 2. Thus, one of skill in the art will appreciate that this embodiment of the present invention does not necessarily require the use of adhesive between the plate 6 and the flange of the wastewater strainer. In one embodiment of the present invention, the adapter is held to the arms 14 of the concealing device by a clip 90. The adapter can be of any size and may be selectively removable if an end user does not wish to use the same. The adapter 82 does not require a seal groove and a cylindrical wall may be used to assist aligning the concealing device 2 over the strainer body. The adapter 82 includes a conduit 94 to allow fluid to flow therethrough.

One of skill in the art will appreciate that the adapter may be integral with the plate 6. For example, a frangible adapter may be associated with the plate 6 that is designed to protrude into the strainer body and that includes weakened areas to allow the adapter to be selectively shortened or completely removed. Similarly, a telescoping adapter may be provided that has the ability to be selectively increased or decreased in length to accommodate various strainer bodies. Further, at least one downwardly-extending tab may be associated with the plate 6. The tabs extend into the strainer body in such away to avoid the hub and spokes associated with the strainer body. The tabs may be frangible or hooks may be employed similar to those taught by U.S. Pat. No. 5,692,248.

Figure 14:
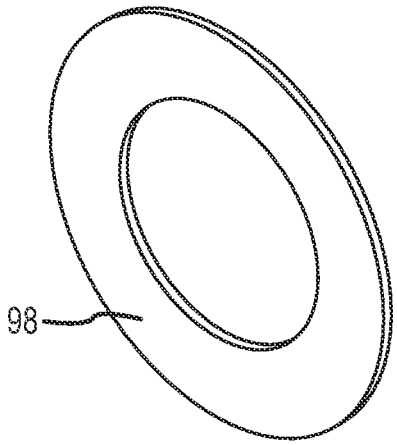
FIG. 14 is a perspective view of an adhesive tape used to secure the concealing device of one embodiment of the present invention to the wastewater strainer.
Figure 15:
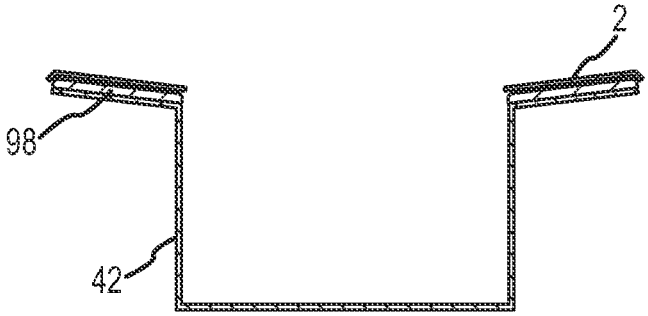
FIG. 15 is a cross sectional view showing a concealing device interconnected to a wastewater strainer.

FIGS. 14 and 15 show an embodiment of the present invention where double-sided tape 98 is employed to interconnect the concealing device 2 to the wastewater strainer 42. More specifically, as outlined above, the concealing device is often fixed to the strainer with an adhesive or sealant. Some silicone sealants, however, are not easy to remove after they cure. To address this issue, two-sided pressure sensitive acrylic closed cell tape is used to bond the concealing device 2 to the wastewater strainer 42. An example of such tape is manufactured by 3M™ and is sold as VHB™ Acrylic Foam Tape, which is resistant to cleaning chemicals, forms a permanent seal, is virtually invisible, and is conforming.

Figure 16:
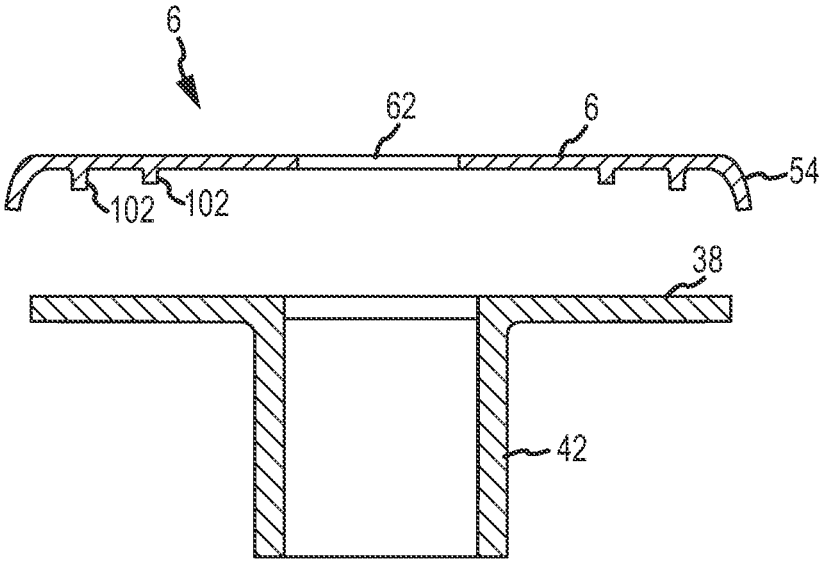
FIG. 16 shows a plate having a plurality of concentric alignment rings.

FIG. 16 shows an alternative embodiment of a plate 6 that includes a plurality of concentrically aligned rings 102. The rings 102 are designed to help align the plate 6 onto the strainer flange 38. More specifically, in most instances, the lip 54 of the plate 6 will contact the outer edge of the flange 38 to align the plate 6. However, in instances where the flange 38 has a diameter smaller than that of the plate 6, an interior ring 102 will contact the outer edge of the flange 33. As shown, the rings 102 are increased in length radially outwardly from the plate opening 62. As such, an inner ring will not interfere with the function of the outermost rings when the plate is engaged onto a small strainer flange. The spaces between each ring will receive adhesive and facilitate the bond between the plate 6 the strainer flange 38.

Figure 17:
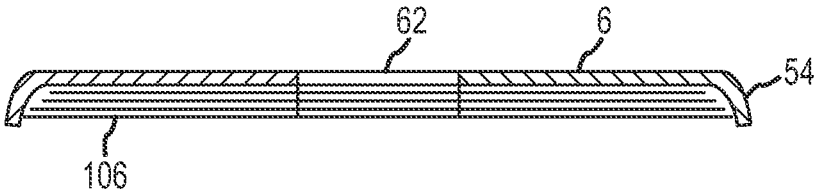
FIG. 17 is a plate of one embodiment that employs a plurality of adhesive sheets.

FIG. 17 shows a plate 6 having a plurality of adhesive sheets 106 associated with its underside. It is contemplated that this plate 6 will be more apt to accommodate strainer flanges of varying thicknesses. In operation, removal of multiple sheets and associated substrates will increase the recess provided by the lip 54 as the deeper the recess, the thicker the strainer flange that can be accommodated. Once the desired recess is achieved, no further adhesive sheets would be removed. In order to maintain the remaining adhesive sheets and associated plate to the flange, the adhesive may be heat activated such that when exposed to hot water, it cures and hardens to prevent removal.

Figure 2:
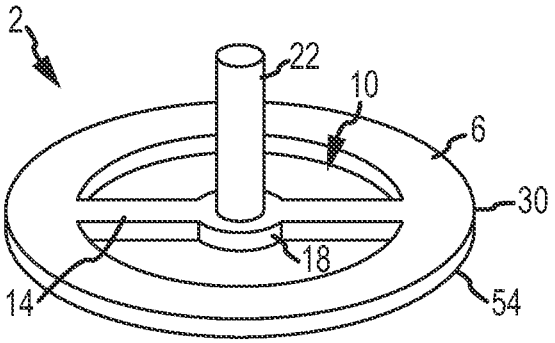
FIG. 2 is a perspective view of one embodiment of the present invention.
Figure 3:
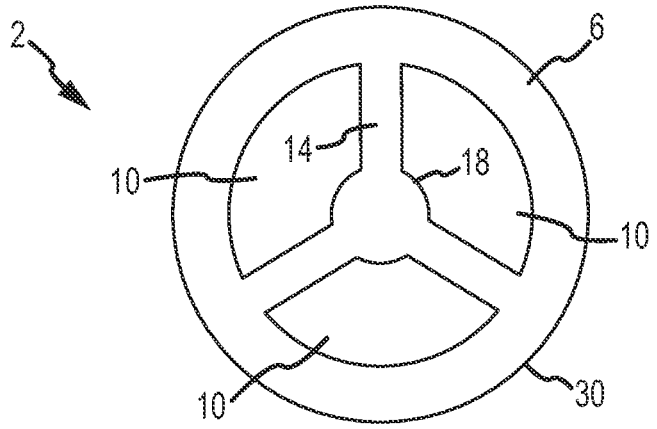
FIG. 3 is a top plan view of another embodiment of the present invention.
Figure 4:
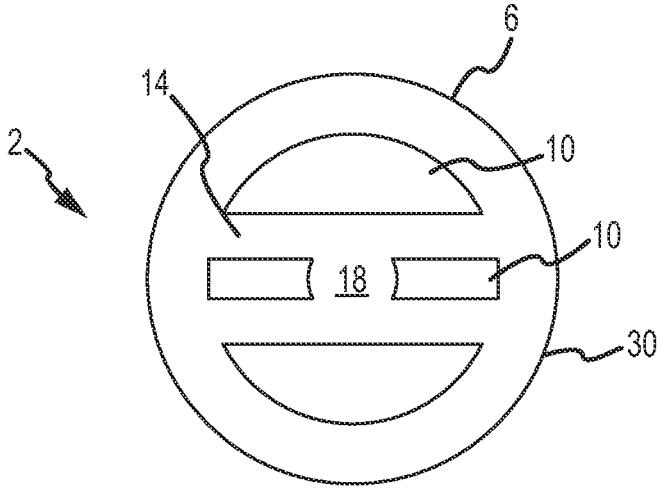
FIG. 4 is a top plan view of another embodiment of the present invention.
Figure 5:
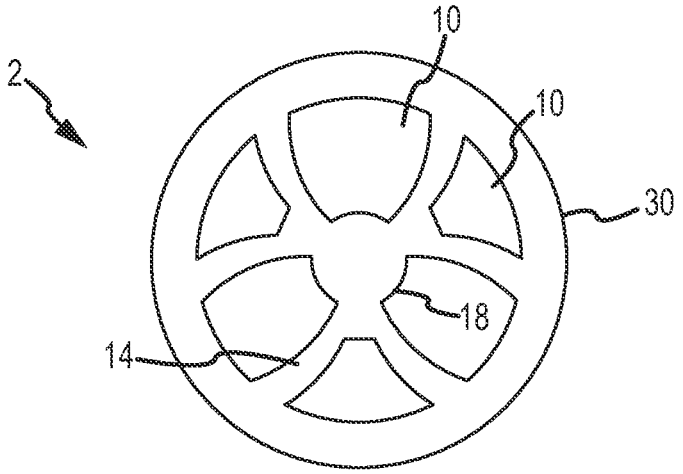
FIG. 5 is a top plan view of another embodiment of the present invention.
Figure 18:
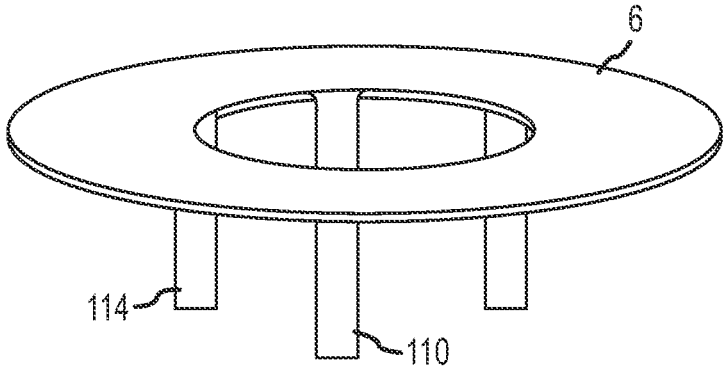
FIG. 18 is a plate having a plurality of removable tabs.

FIG. 18 shows yet another way to align the plate 6 of one embodiment of the present invention. This plate has a plurality of tabs 110 that are designed to fit within the strainer. That is, the tabs 110 are spaced such that the crossed members of the strainer body, or spokes 194 (see FIG. 41) are accommodated between the tabs. The tabs 110 may also be frangible a weakened area such as score lines 114 to decrease their height and width. In one embodiment of the present invention, the tabs 110 are completely removable to yield a plate as shown in FIG. 2, for example. The tabs 110 may be flexible and splayed outwardly or bowed to be flexed inwardly to engage the inner surface of the strainer body to enhance engagement between the plate 6 and the strainer.

Figure 19:
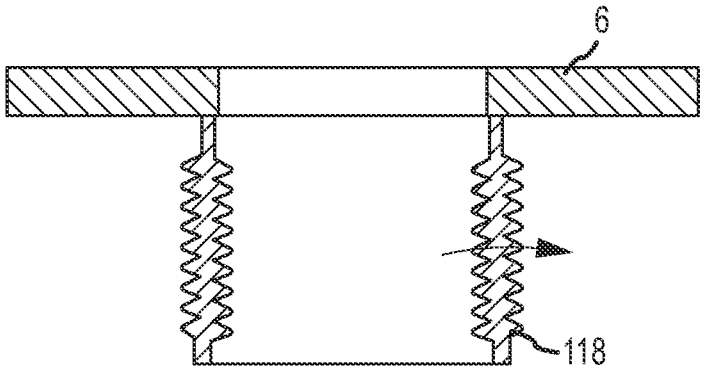
FIG. 19 is a plate having aligning bellows.
Figure 20:
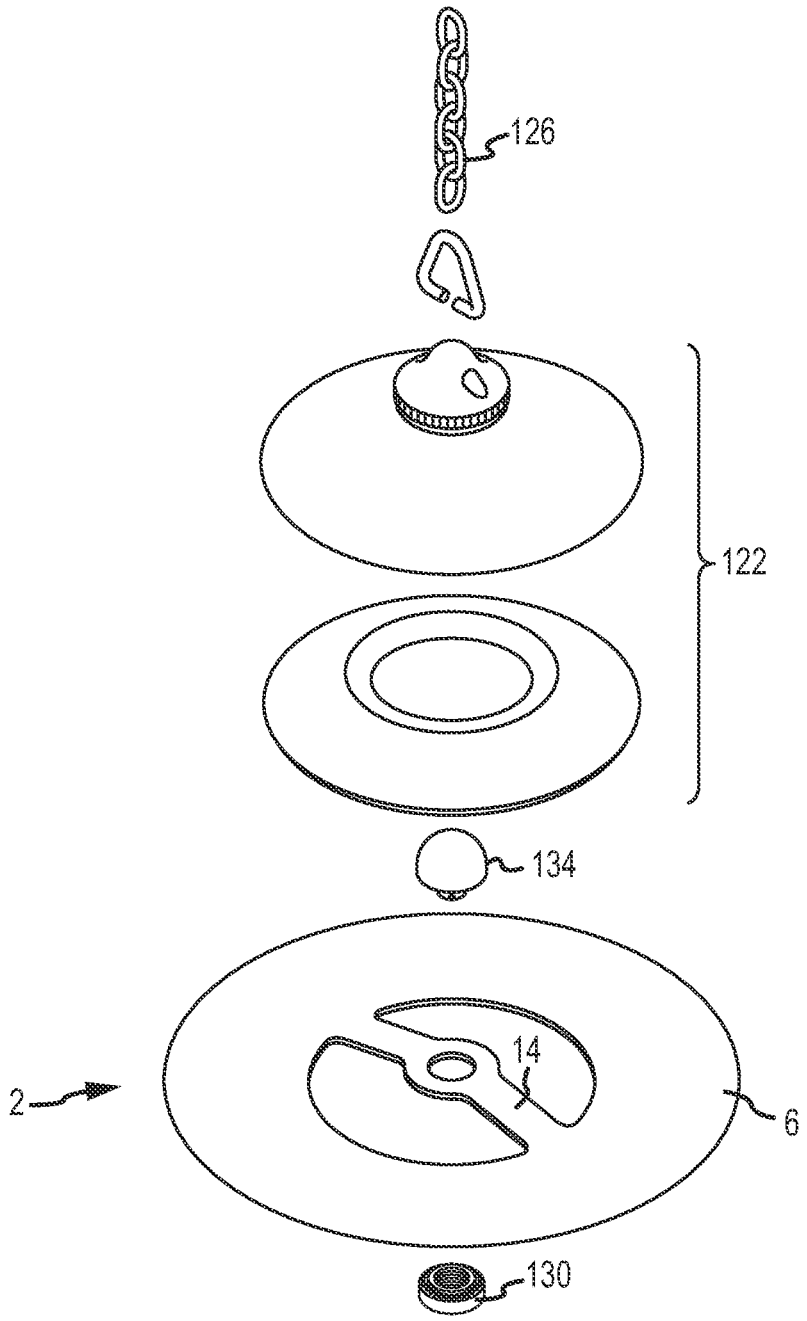
FIG. 20 is an exploded perspective view of a chain and stopper that is used in connection with a concealing device of one embodiment.
Figure 21:
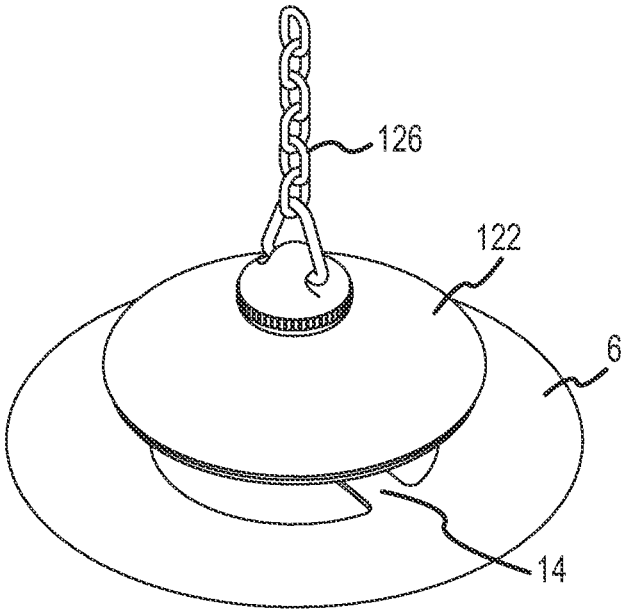
FIG. 21 is a perspective view of a chain and stopper of FIG. 20 shown in an open configuration.
Figure 22:
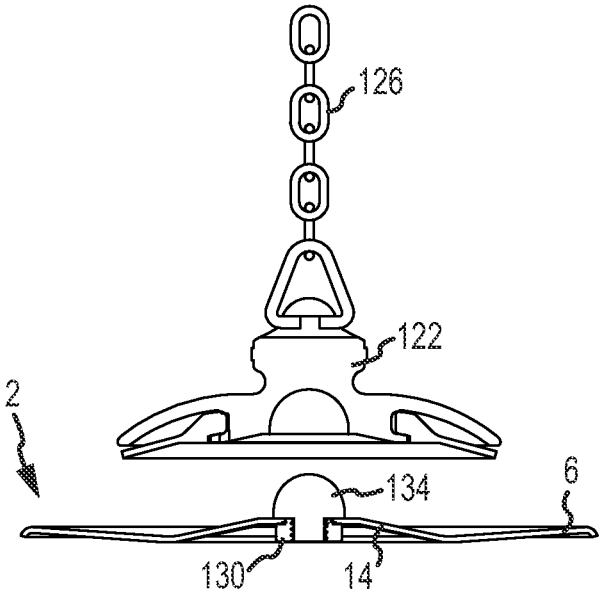
FIG. 22 is a cross-sectional view of FIG. 21.
Figure 23:
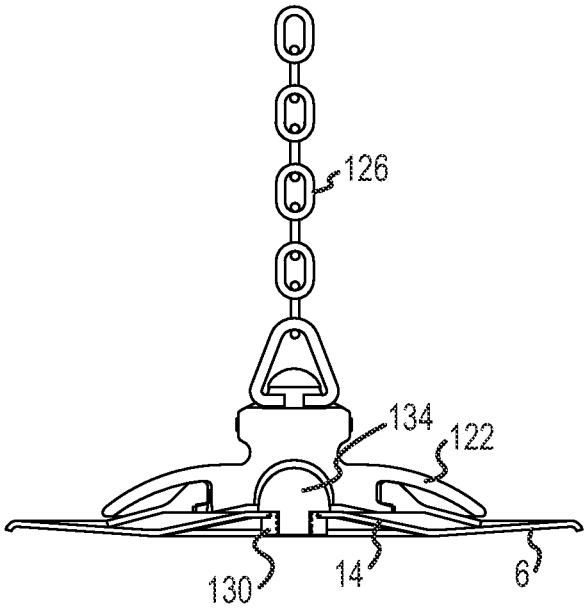
FIG. 23 is a cross-sectional view of FIG. 21 shown in a closed configuration.
Figure 24:
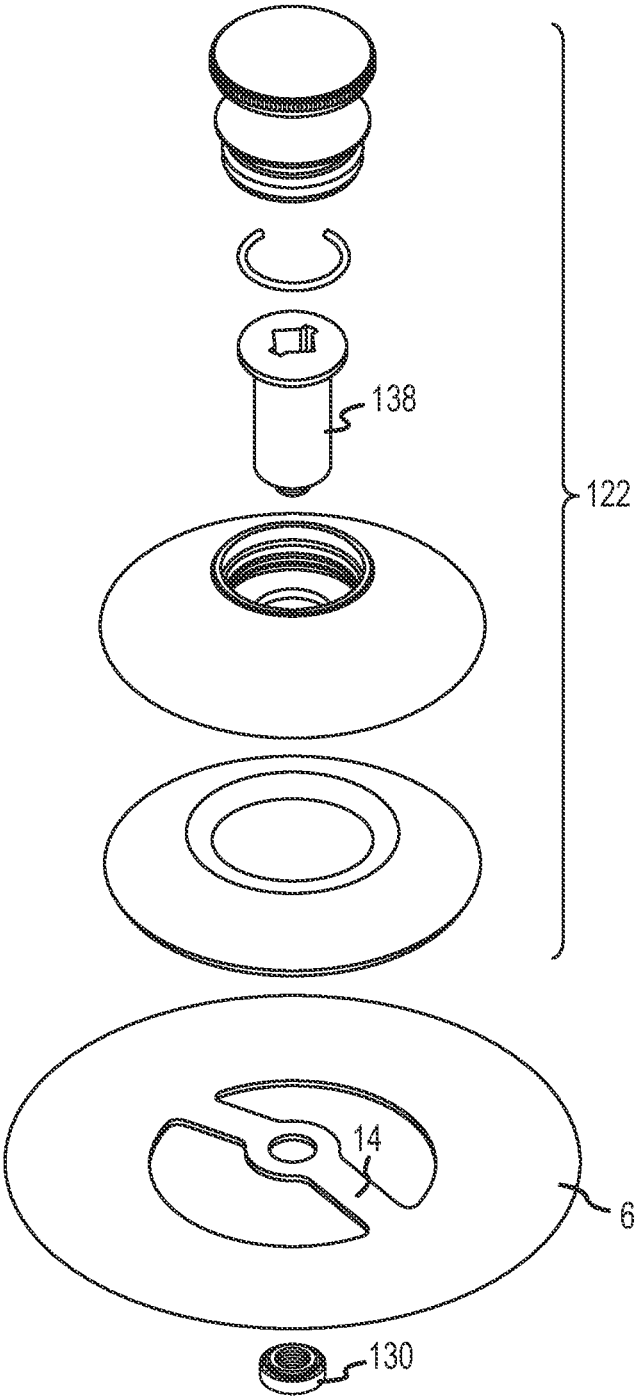
FIG. 24 is an exploded perspective view of a push/pull stopper that is used in connection with a concealing device of one embodiment.
Figure 25:
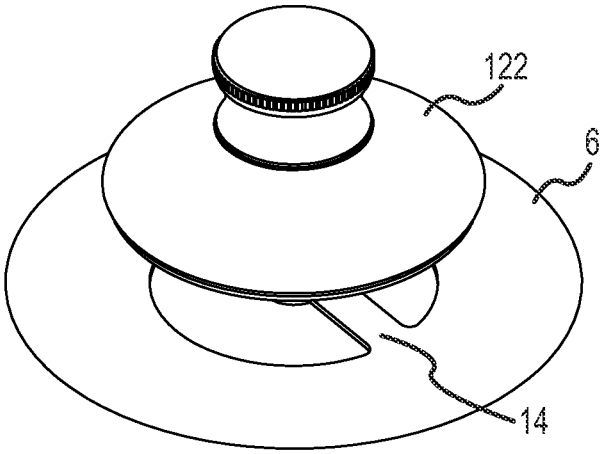
FIG. 25 is a perspective view of the push/pull stopper of FIG. 24 shown in an open configuration.
Figure 26:
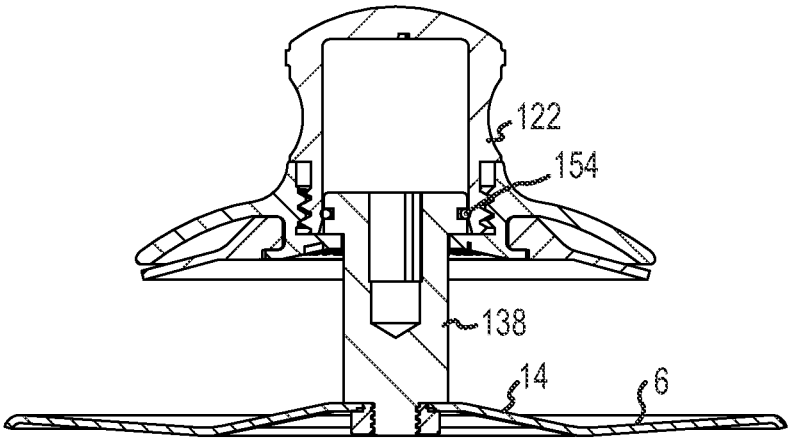
FIG. 26 is a cross-sectional view of FIG. 24.
Figure 27:
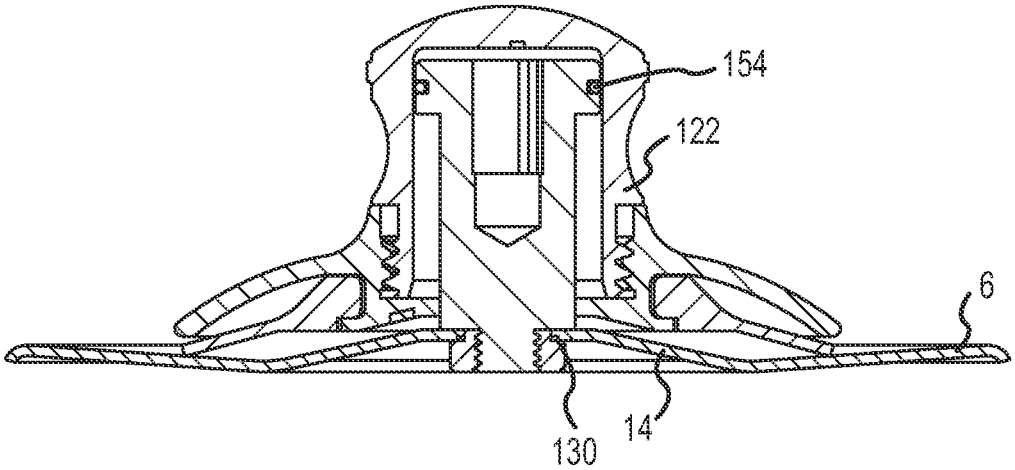
FIG. 27 is a cross-sectional view of FIG. 24 shown in a closed configuration.
Figure 28:
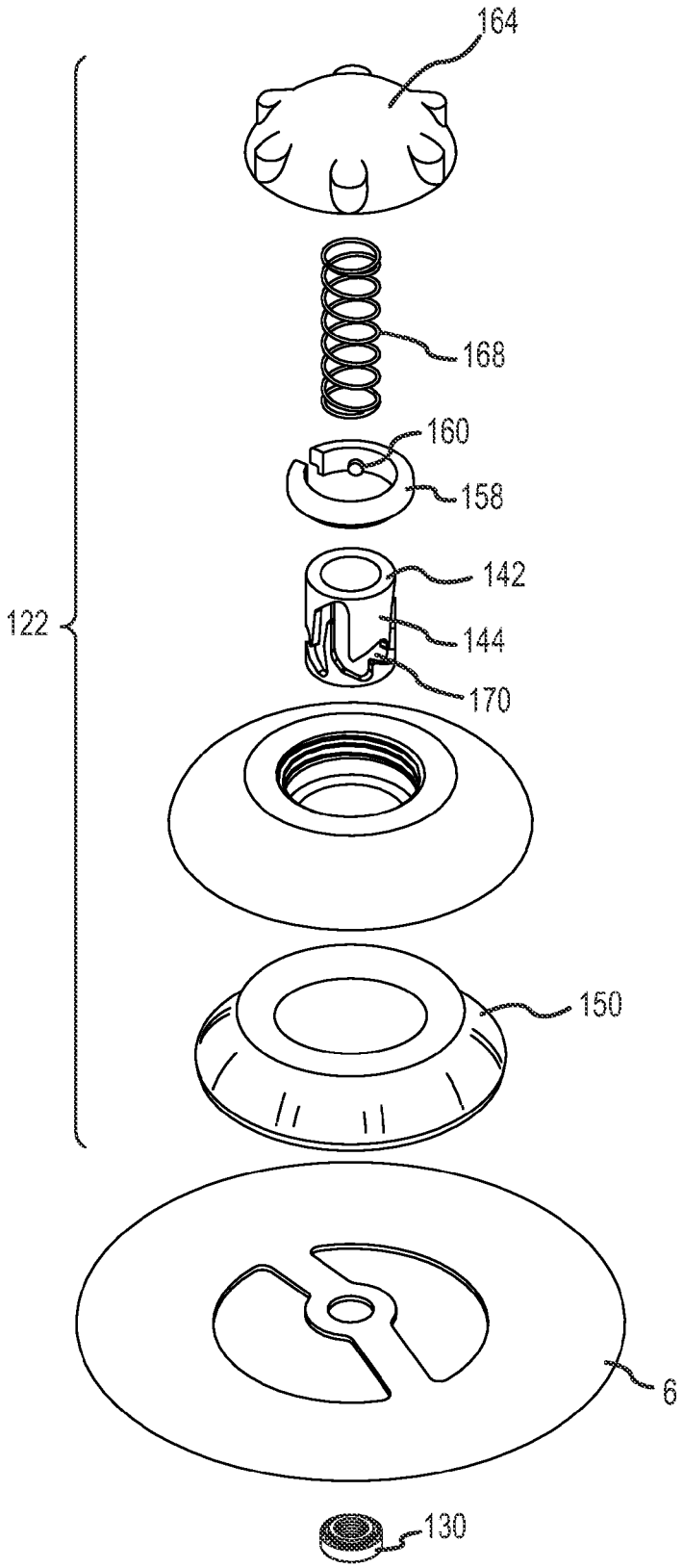
FIG. 28 is an exploded perspective view of a foot-actuated stopper that is used in connection with a concealing device of one embodiment.
Figure 29:
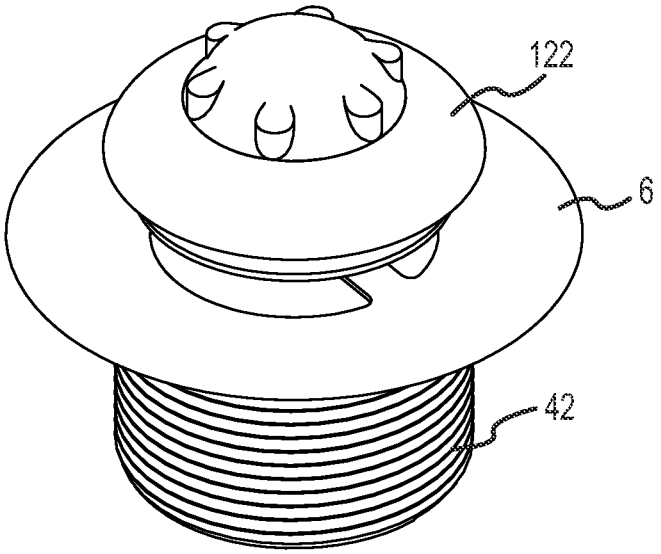
FIG. 29 is a perspective view of a foot-actuated stopper shown in an open configuration.

FIG. 19 shows an alternate embodiment of a plate having a bellows portion 118 extending therefrom that helps align the plate 6 onto the strainer body. The bellows portion 118 will compress when it contacts the cross members of the strainer body, thereby allowing the plate to be used on various types of strainer bodies. Once skilled in the art will appreciate that the bellows portion may be made with a plurality of openings to allow fluid flow therethrough. The bellows section may also be made of thin material such that it can be cut to a desired length or removal from the plate.

FIGS. 20-23 show a stopper 122 and chain 126 used in conjunction with a concealing device 2 of one embodiment of the present invention. As discussed above, the plate 6 of embodiments of the present invention can accommodate stoppers of various configurations. Here, the plate includes arms 14 that are slightly raised that receive a PEM insert 130. One of skill in the art will appreciate that the plate may be devoid of arms wherein the stopper rests in the opening in the plate. The PEM insert 130 receives a centering dome 134 that helps align the stopper 122 on the plate 6. As can be appreciated upon review of FIG. 23, for example, no part of the stopper 112 is positioned in the strainer body when the drain is closed. Thus, the stopper is universal and can be used in conjunction with embodiments of the present invention to accommodate any strainer body.

Referring now to FIGS. 24-27, a push/pull stopper 122 used in conjunction with embodiments of the present invention is shown. As described above, a PEM insert 130 is incorporated into the plate 6. The PEM insert 130 receives a carrier 138 that is associated with the stopper. Again, no part of the stopper 122 extends below the plate 6. A friction ring 154 is used to maintain the stopper in an open or closed configuration.

FIGS. 28-31 show a foot-actuated stopper 122 of embodiments of the present invention. Here, a rotatable carrier 142 with a groove that acts as a guide path 144 is associated with a stopper body 146. The stopper body 146 includes a ring 158 having a detent 160. The carrier 142 is rotatably interconnected to the hub 18 of the plate 6 by a screw 162 that is received by a PEM insert 130. When the cap 164 is pressed down, the ring 158 moves downwardly along the guide path 144 which rotates the carrier 142. More specifically, the carrier 142 will rotate to allow the detent 160 to follow its intended path and bring the seal 150 in contact with the plate 6. One of skill in the art will appreciate that the carrier 142 may be stationary and affixed to the plate 6 and the ring 158 be made to rotate as the stopper 122 is pressed downwardly. Eventually the seal 150 will contact the plate 6 to prevent fluid flow through the strainer body. At that point, pressure on the stopper 122 is released and the spring 168 recoils which forces the stopper 122 upward. The guide path 144, however, prevents upward movement of the ring 158 and interconnected stopper body 146 because the detent 160 of the ring 158 are firmly seated in a capture portion 170 of the guide path 144. That is, the interaction of the ring 158 with the guide path 144 will prevent separation of the seal 150 from the plate 6.

To open the drain stopper 122, pressure is again added to the cap 164, which causes the detent 160 to rotate in the carrier 144. As the carrier 142 rotates, the detent 160 will eventually reach a portion of the guide path 144 wherein no obstructions will prevent the ring 158 and interconnected stopper body 146 from traveling upward under the force provided by the spring 168 to open the drain stopper 122.

Figure 30:
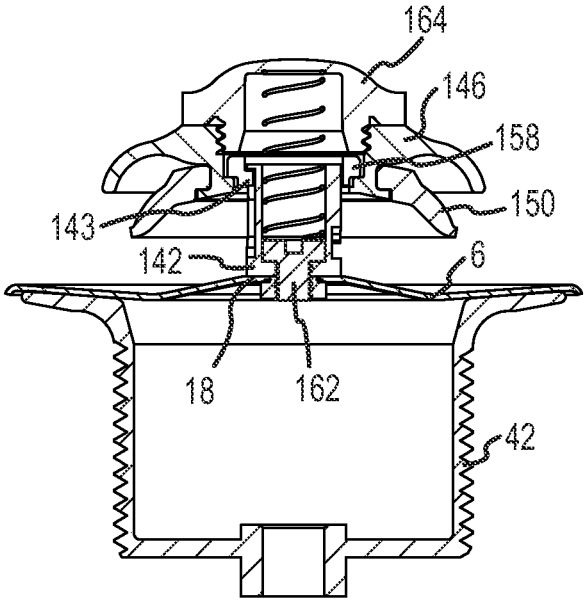
FIG. 30 is a cross-sectional view of FIG. 28.
Figure 31:
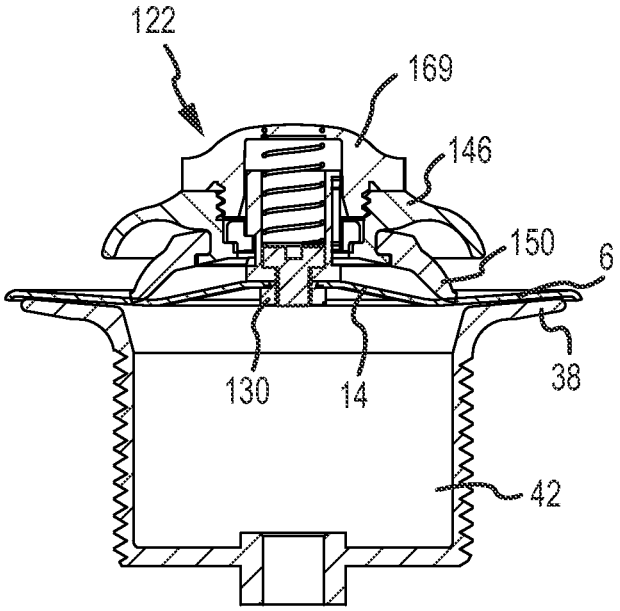
FIG. 31 is a cross-sectional view of FIG. 28 in a closed configuration.
Figure 32:
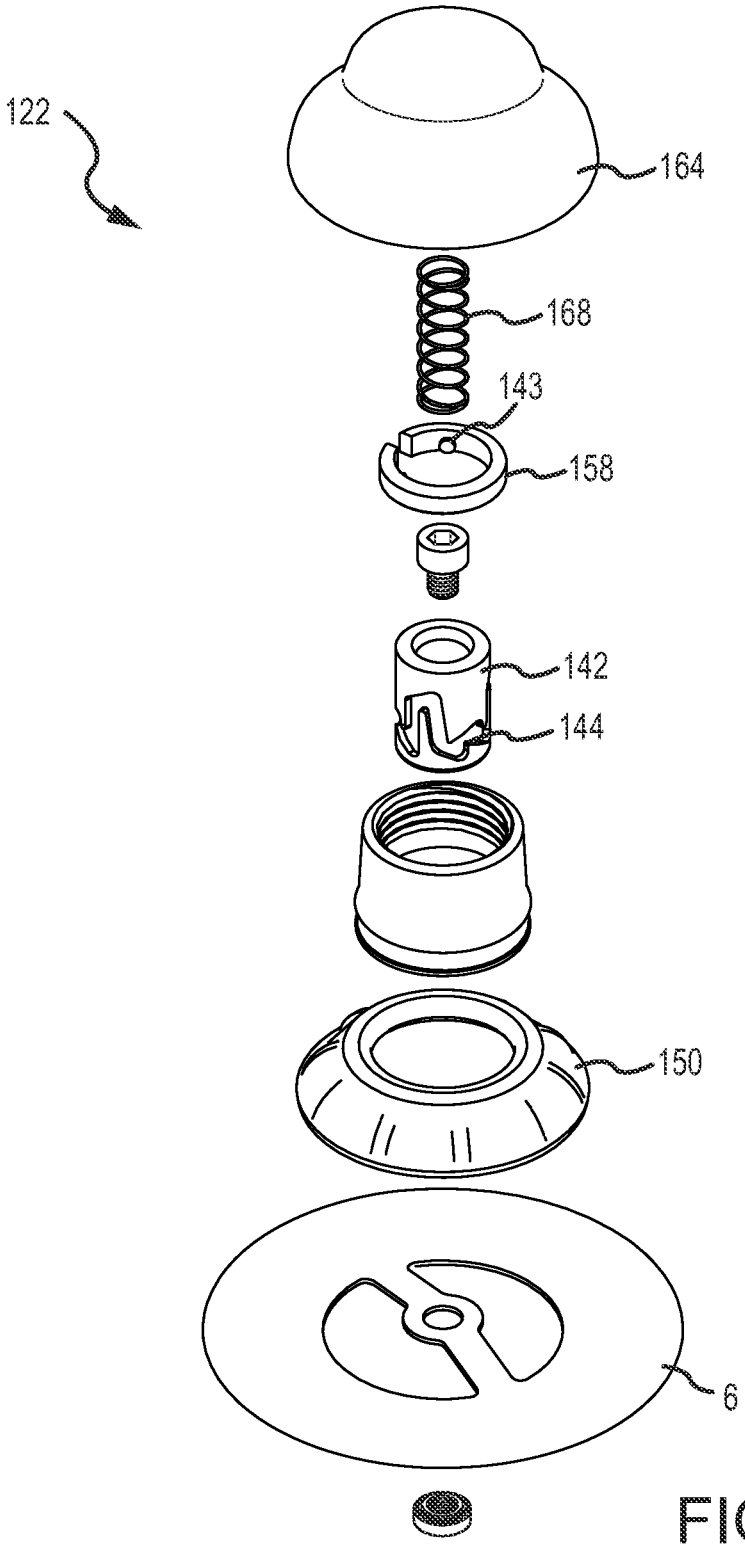
FIG. 32 is an exploded perspective view of a foot-actuated stopper that is used in connection with a concealing device of one embodiment.
Figure 33:
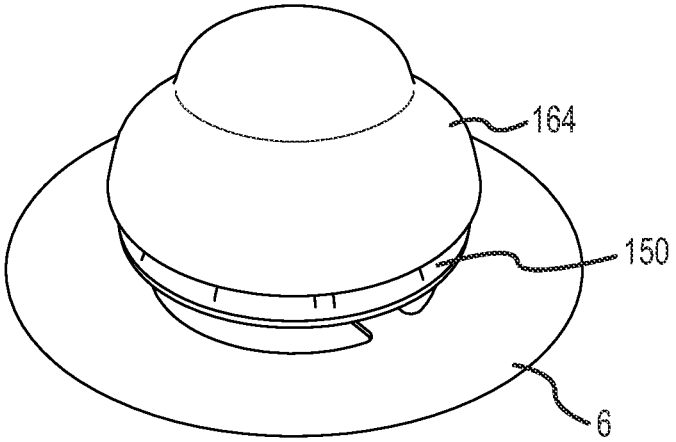
FIG. 33 is a perspective view of the foot-actuated stopper shown in an open configuration.
Figure 34:
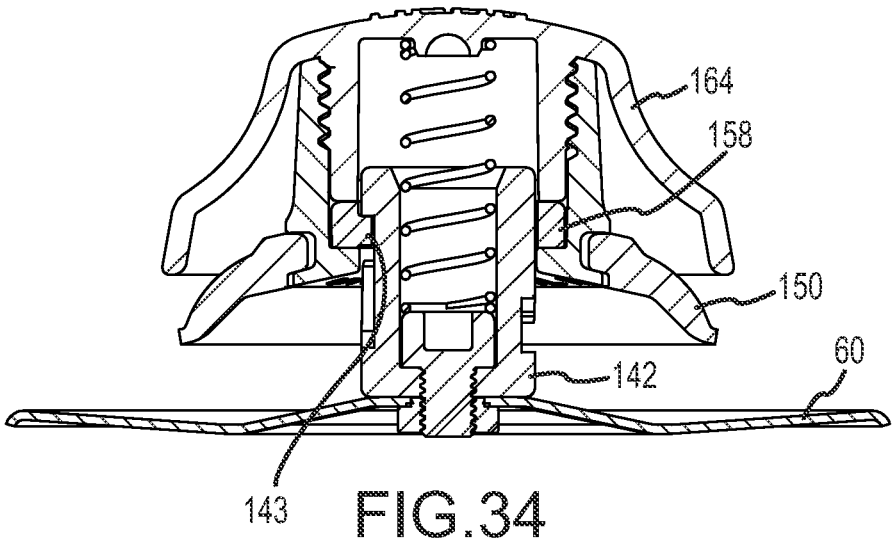
FIG. 34 is a cross-sectional view of FIG. 32 shown in an open configuration.
Figure 35:
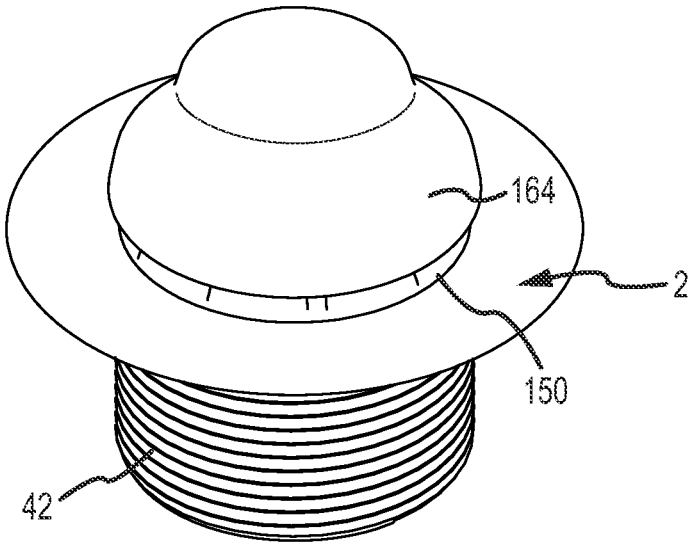
FIG. 35 is a foot-actuated drain stopper of one embodiment of the present invention that is selectively interconnected to a traditional strainer body.
Figure 36:
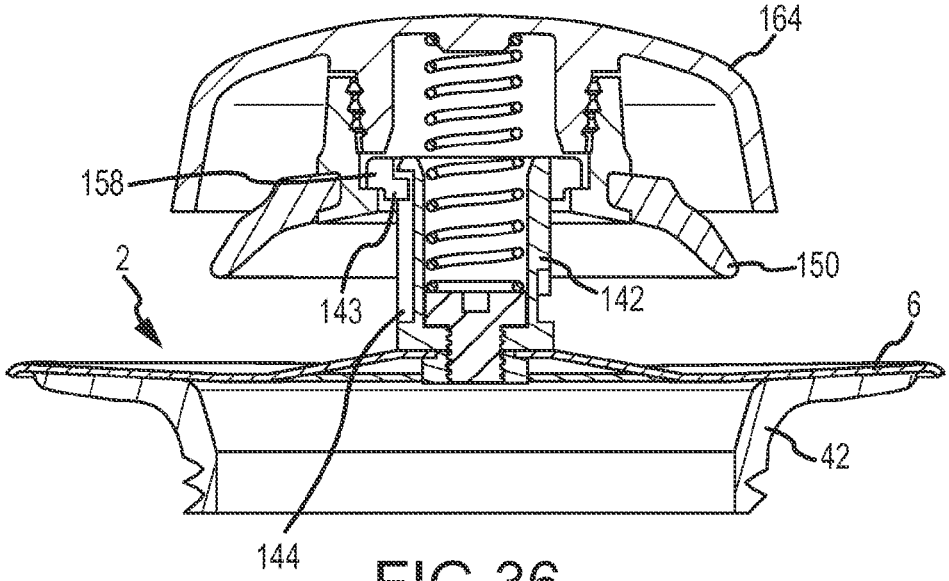
FIG. 36 is a cross sectional view of the system shown in FIG. 35 shown in an open configuration.
Figure 37:
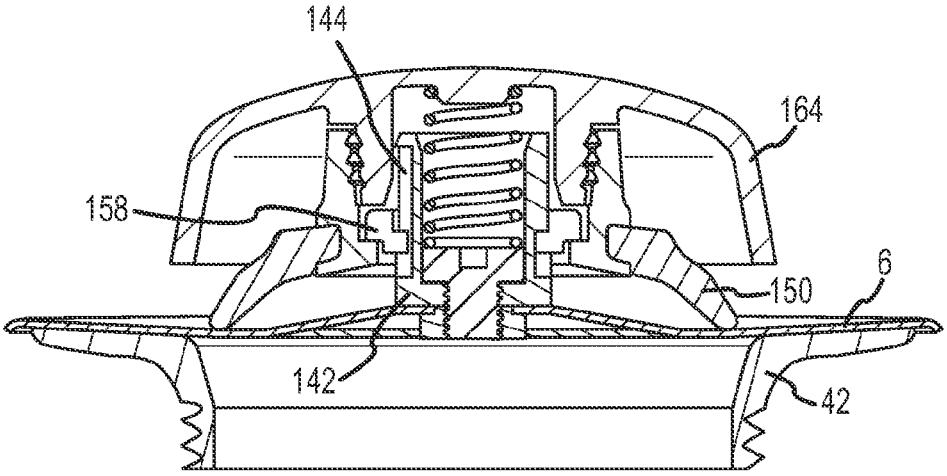
FIG. 37 is a cross-sectional view of the system shown in FIG. 35 shown in a closed configuration.
Figure 38:
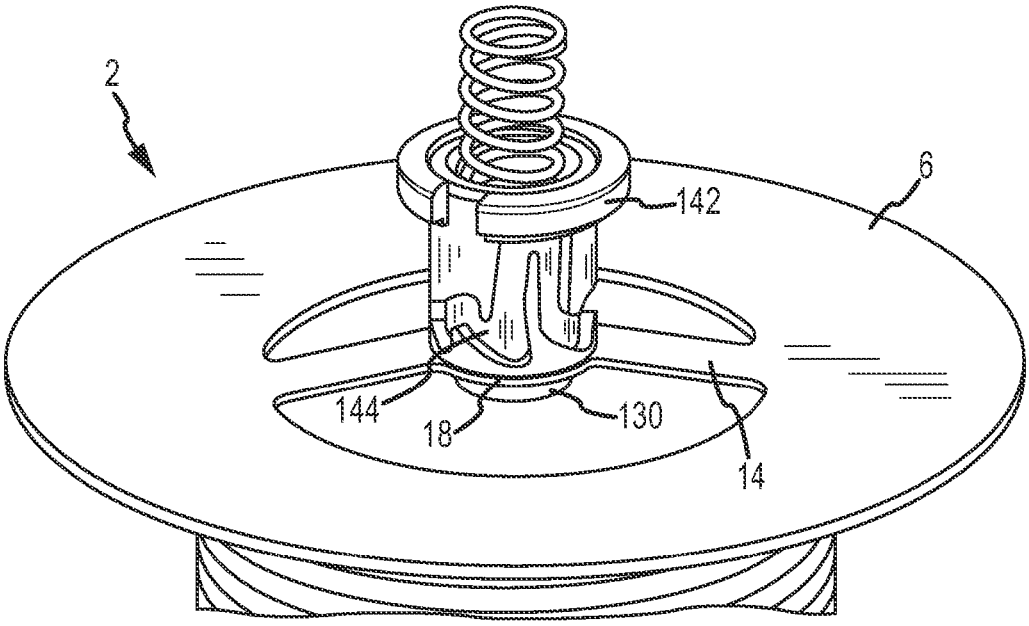
FIG. 38 is a perspective view of the system of FIG. 35 wherein the drain stopper has been removed for clarity.

FIG. 30 shows the wastewater strainer 42 wherein the plate 6 is positioned on the flange 38 thereof. Again, no portion of the plate 6 or the foot-actuated stopper 122 substantially protrudes into the wastewater strainer 42, thereby making this combination and other foot-actuated stopper and plate combinations universal.

Referring now to FIGS. 32-38, another embodiment of the present invention is shown that is similar to that shown in FIGS. 28-31. More specifically, a cap 164 is interconnected to the rotatable carrier 142 having a guide path 144 that operatively receives a detent 160 of a ring 158. The ring 158 rotates the carrier 142 as the cap is pressed towards the plate 6. In this way, the cap and associated seal 150 are brought in contact with the plate 6 or removed therefrom. The spring 168 rests against a screw that is interconnected to a PEM fastener. The spring and guide member 142 are thus able to rotate relative to the fixed screw when the cap is moved toward and away from the plate.

Figure 39:
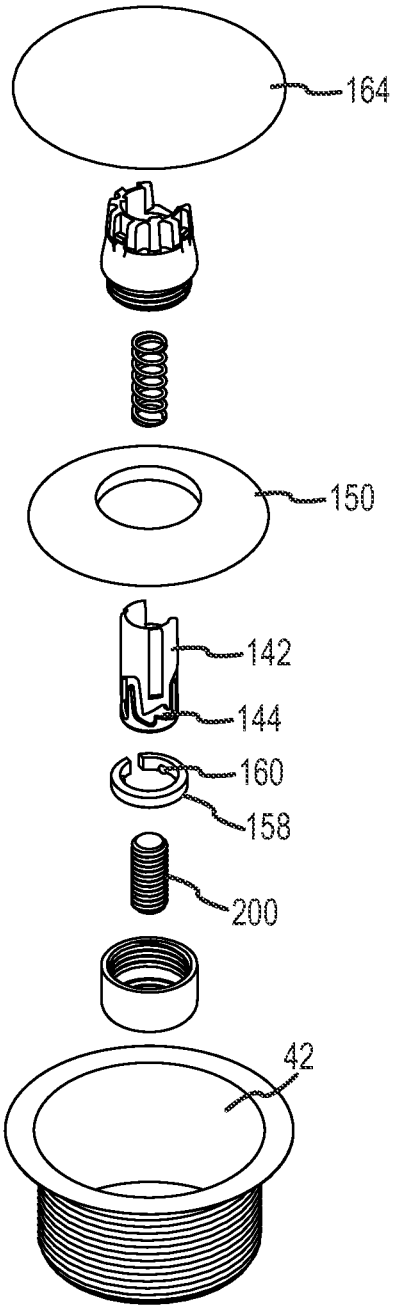
FIG. 39 is an exploded perspective view of a foot-actuated drain stopper of another embodiment of the present invention that is selectively interconnected to a traditional strainer body.

FIG. 39 shows another embodiment of the present invention that is not necessarily associated with a strainer flange concealing plate as shown and described above. More specifically, this embodiment of the present invention is more aptly associated with a traditional strainer body wherein an elongated adapter 200 is used to rotatably interconnect the carrier 142 to the strainer 42. One of skill in the art will appreciate that the carrier 142 may be directly interconnected to a hub of the strainer 42. The ring 158 is also operably associated with the guide path 144 and thus functions similar to the embodiments described above with respect to FIGS. 33-38. In this and other embodiments described herein, the detent 160 may have an outer dimension that is less than the width of the guide path, wherein the cap 164 and associated components are able to tilt relative to the strainer flange 42. The ability of the cap to wobble is desirable as it allows enhanced access into the strainer, which is useful in removing hair and other debris from the strainer. Also, wobbling will allow the cap to move when laterally contacted, which will prevent or reduce foot or toe injuries associated with inadvertently kicking the foot-actuated stopper.

Figure 40:
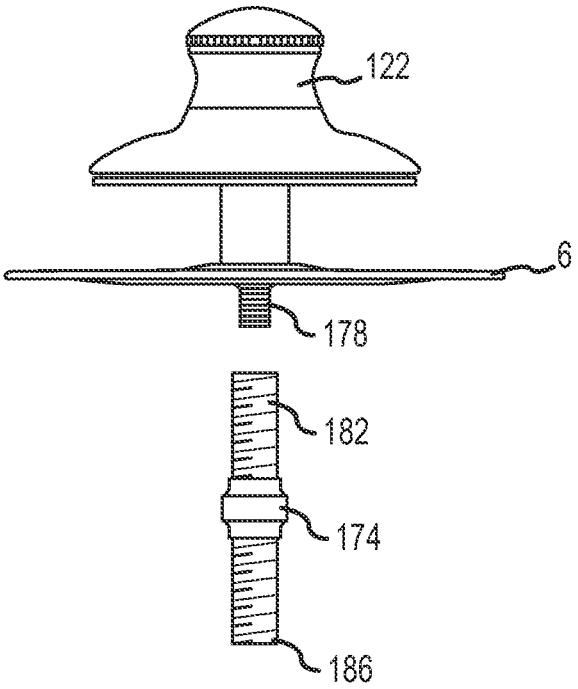
FIG. 40 is a front elevation view of one embodiment of the present invention that is interconnected to the waste water strainer by way of a connector.
Figure 41:
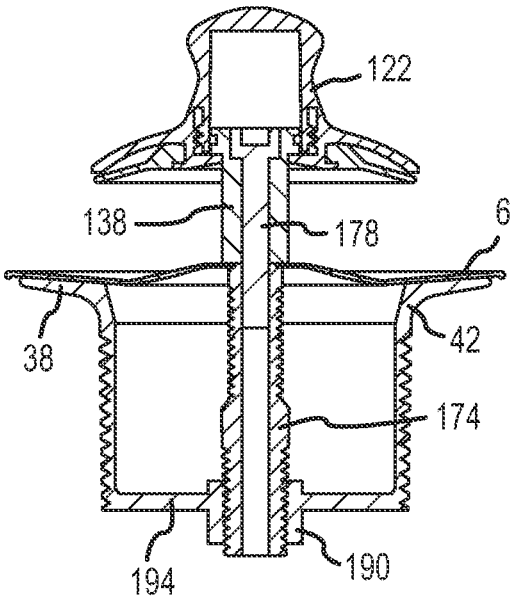
FIG. 41 is a cross section of FIG. 40.

FIGS. 40 and 41 show a concealing device of one embodiment of the present invention interconnected to a strainer body 42. More specifically, a connector 174 is provided having a first end 182 and a second end 186. Both ends may be internally threaded to receive a bolt 178 that is associated with the plate 6 that conceals the flange 38 of the strainer body 42. The bolt extends through the concealing device and threads into either the internal diameter of the first end 182 or the internal diameter of the second end 186. The bolt 178 also holds the carrier in place 138. The first end 182 and the second end 186 also include external threads for receipt within a hub 190 that is interconnected by a plurality of spokes 194 to the cylindrical portion of the strainer body 42. The internal diameter of the hub 190 will dictate which side of the connector 174 is threaded into the hub 190 and which side receives the bolt 178. In this fashion, the plate 6 is firmly engaged against the flange 38 and conceals the same.

Figure 42:
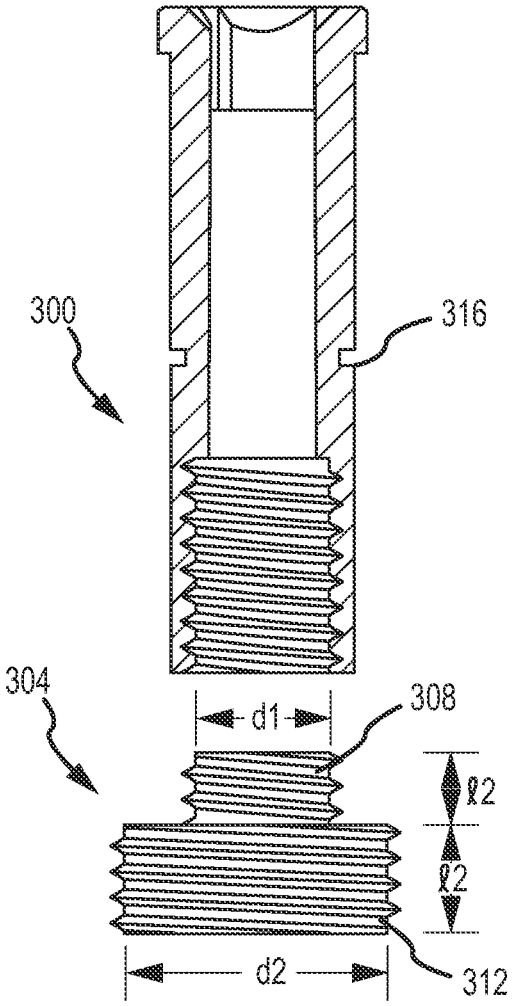
FIG. 42 is a partial cross section showing a foot-actuated drain stopper associated to a carrier that is interconnected to a hub of a strainer body.

Referring now to FIG. 42, a carrier of another embodiment of the present invention is shown. Here, the carrier 300 is interconnected to a hub of an existing strainer or a new strainer by way of an adapter 304. The adapter 304 is comprised of a first portion 308 and a second portion 312 wherein the first portion 308 has a diameter less than that of the second portion 312. The first portion 308 selectively engages the carrier 300 by way of a threaded interconnection. The second portion 312 engages the hub of the strainer body. The carrier 300 also has a groove 316 for receipt of a friction ring associated with the stopper as described above. One of skill in the art will appreciate that the adapter 304 may be inverted wherein the first portion 308 engages the hub of the strainer body and the second portion 312 engages a carrier 300.

Figure 43:
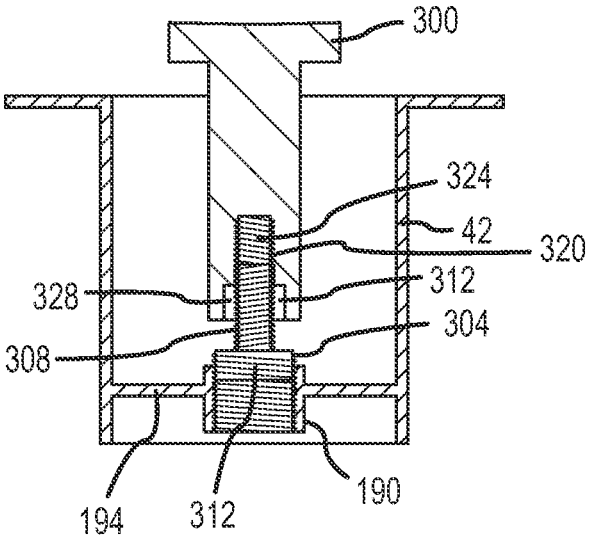
FIG. 43 is a partial cross section showing a carrier and associated threaded adapter.
Figure 44:
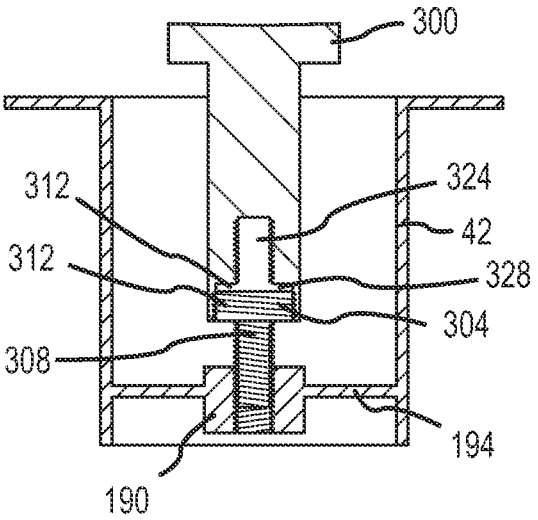
FIG. 44 is a partial cross section showing a carrier and associated threaded adapter.

FIGS. 43 and 44 show a carrier 300 having a tapped hole 320 for receipt of the adapter 304. The tapped hole 304 has a first portion 324 and a second portion 328 wherein the second portion 328 has a greater diameter than the first portion 324. The adapter may have an elongated first portion 308 (L1) that is received within the first portion 324 of the carrier 300. The second portion 312 of the adapter interfaces with a hub 190 of the strainer body. If the hub has a small-diameter bore, the first portion 308 of the adapter is interfaced with the hub 190 and the second portion 312 of the adapter is received by the second portion 328 of the carrier 300. In this way, a single carrier/adapter combination may be used on various strainer bodies. Again, one of skill in the art will appreciate that the relative dimensions of the adapter first portion and the second portion i.e., the length and diameters may be increased or decreased to accommodate many types of strainer bodies. Further, a plurality of adapters may be used that are selectively interconnected series to provide a desired offset between the top surface of the carrier 300 and the hub 190 which allows for the adapter combination to be used with various strainer bodies.

Figure 45:
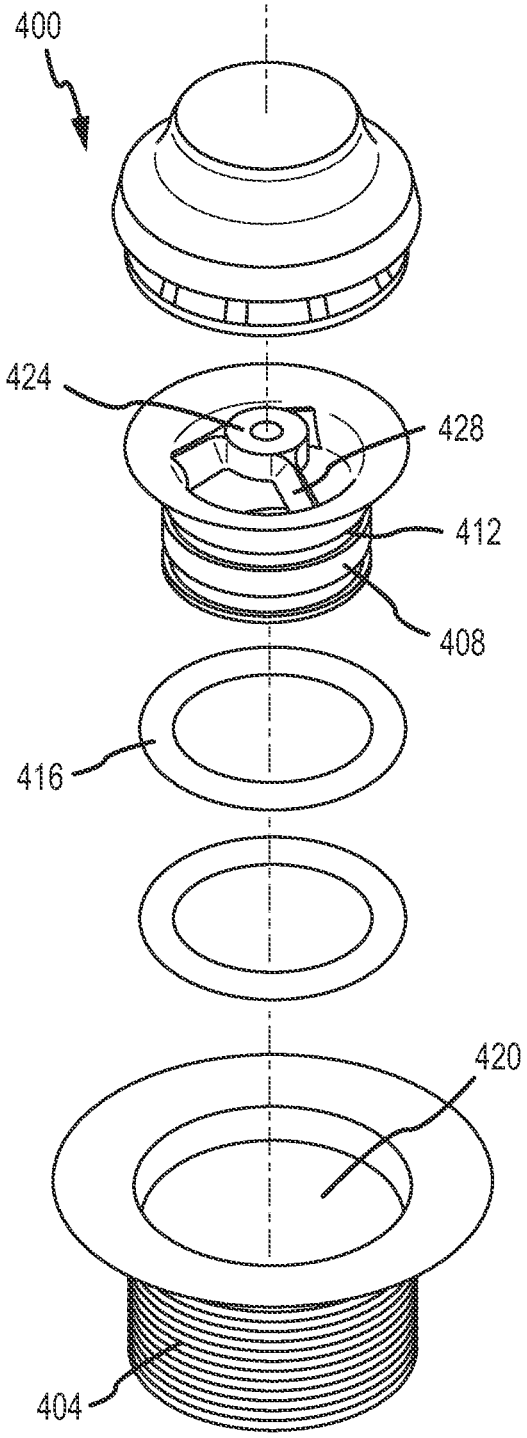
FIG. 45 is a perspective view of another embodiment of the present invention wherein the foot actually stopper is associated with an adapter.

FIG. 45 is a perspective view showing another embodiment of the present invention wherein the foot-actuated stopper 400 is interconnected to a strainer body 404 by way of an adapter 408. The adapter 408 may have at least one groove 412 for the receipt of an 0-ring 416 that helps firmly secure the adapter 408 to an inner wall 420 of the strainer body 404. The adapter 408 includes a hub 424 that is supported by at least one arm 428. The hub 424 receives a carrier associated with the foot-actuated stopper as described above.

Figure 46:
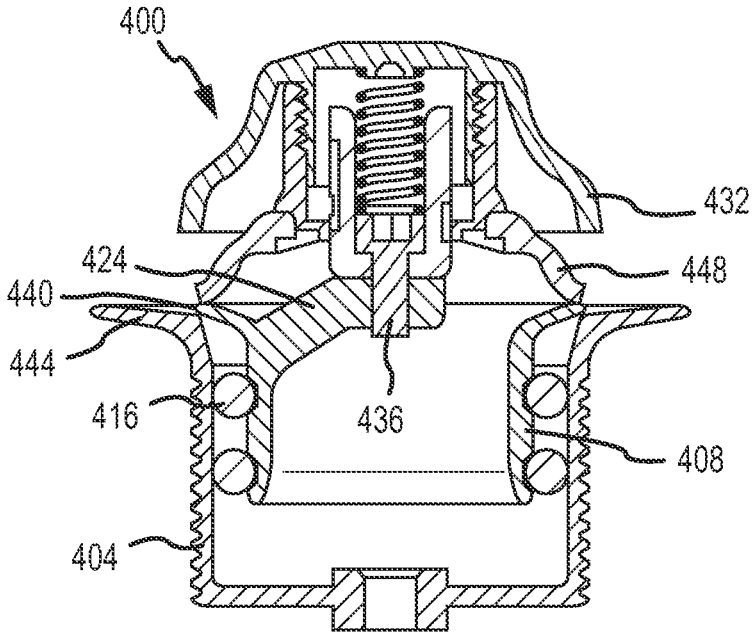
FIG. 46 is a cross-sectional view of the adapter positioned within a strainer body.
Figure 47:
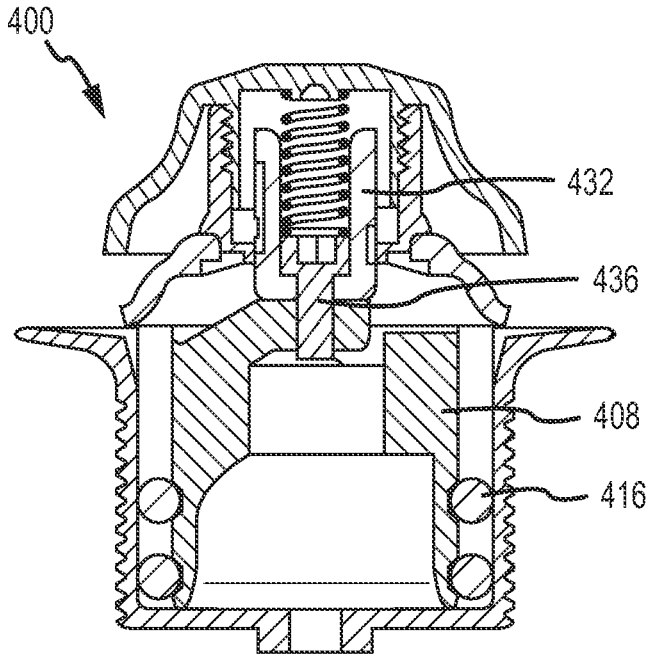
FIG. 47 is a cross-sectional view of an adapter of another embodiment of the present invention positioned within a strainer body.

FIGS. 46 and 47 show the adapter 408 inserted into the strainer body 404 wherein at least one o-ring 416 secures the adapter 408 into the strainer body 404. The hub 424 receives a carrier 432 that is secured thereto by way of a screw 436, which is described above. In operation, the foot-actuated stopper 400 functions as described above. In FIG. 46, the adapter 408 has a lip 440 that prevents the foot stopper 400 from entering the strainer body 404. In some instances, such as shown in FIG. 47, the lip is not required as the flange 444 of the strainer body 404 is dimensioned to prevent the seal 448 of the foot-actuated stopper 400 from entering the strainer body 404. In other embodiments, however, the lip extends over and conceals at least a portion of the strainer flange 444, similar to the systems and devices described in U.S. Patent Application Publication No. 2013/0055494, filed Nov. 5, 2012, which is incorporated by reference herein. Further, one of skill in the art will appreciate that the at least one o-ring may be replaced with the sealing devices described in U.S. Patent Application Publication No. 2013/0055494, such as an enlarged seal.

Figure 48:
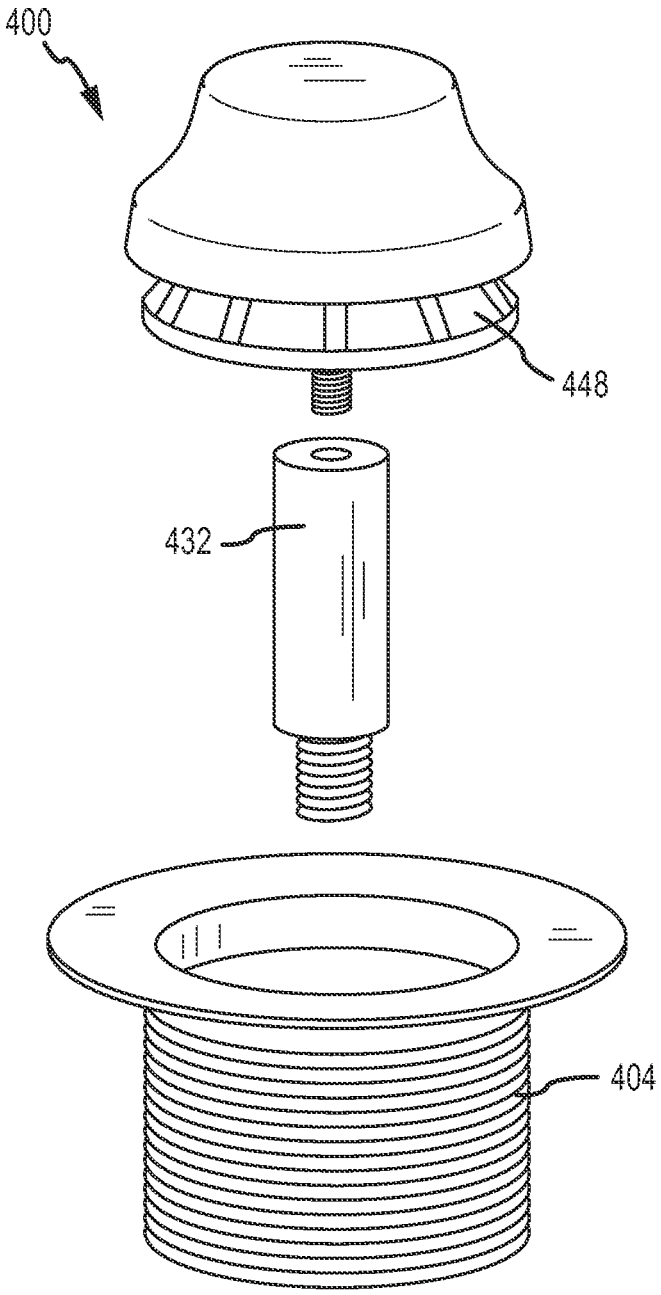
FIG. 48 is a perspective view showing a foot-actuated stopper that is interconnected to a strainer body by way of a carrier.

Turning now to FIG. 48, another way of interconnecting the foot-actuated stopper 400 to the strainer body is shown. The foot-actuated stopper is interconnected via a carrier 432 to the strainer body 404 similar to that shown in FIGS. 40 and 41. Here, the foot-actuated stopper is directly associated with the hub of the strainer wherein a strainer-covering device is omitted. The carrier of one embodiment of the invention includes a guide path that operatively receives a ring associated with a cap as described above.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the claims provided herewith. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Furthermore, one of skill in the art will appreciate that the invention described herein may be used with or incorporated into any of the inventions in the patents and applications listed: U.S. Pat. No. 5,692,248, entitled "Method and Means for Covering the Flange of a Wastewater Strainer"; U.S. Pat. No. 5,745,931, entitled "Method and Means for Covering the Flange of a Wastewater Strainer"; U.S. Pat. No.7,503,083, entitled "Method and Means for Covering the Flange of Wastewater Strainer"; U.S. Pat. No. 5,890,241, entitled "Method and Means for Installing Overflow Outlets to Bathtubs and the Like", U.S. Pat. No. 6,066,119, entitled "Wastewater Strainer and Valve"; U.S. Pat. No. 6,148,454, entitled "A Solenoid Control for a Bathtub Wastewater Drain"; U.S. Pat. No. 6,154,898, entitled "Wastewater Drain Control for Fluid Compartments"; U.S. Pat. No. 6,173,459, entitled "A Control For a Bathtub Wastewater Drain"; U.S. Pat. No. 6,226,806, entitled "Wastewater Strainer and the Like"; U.S. Pat. No. 6,317,906, entitled "Strainer Assembly for Bathtub Drains and the Like": U.S. Pat. No. 6,418,570, entitled "Drain Closure"; U.S. Pat. No. 6,546,573, entitled "Drain Cover Assembly"; U.S. Pat. No. 6,631,623, entitled "Condensate Drain Attachments and Method of Use Thereof"; U.S. Pat. No. 6,637,050, entitled "Overflow Assembly for Bathtubs and the Like"; U.S. Pat. No. 6,640,358, entitled "Strainer Assembly for Bathtub Drains and the Like"; U.S. Pat. No. 6,675,406, entitled "Overflow Assembly for Bathtubs and the Like"; U.S. Pat. No.6,675,407, entitled "Solenoid Activated Bathtub Drain Closure"; U.S. Pat. No. 6,681,420, entitled "Method and Apparatus for Installing a Bathtub Assembly"; U.S. Pat. No. 6,691,411, entitled "Method of Installing a Wastewater Drain Assembly for a Bathtub"; U.S. Pat. No. 7,127,752, entitled "Overflow Assembly for Bathtubs and The Like"; U.S. Pat. No. 7,451,502, entitled "Bath Drain Closure Assembly"; and U.S. Pat. No. 7,503,083, entitled "Means for Covering the Flange of a Wastewater Strainer"; U.S. Patent Application Publication Nos. 20040117907, entitled "Method and Apparatus for Assembling and Sealing Bathtub Overflow and Wastewater Ports "; 20080047060, entitled "Control for a Bathtub Wastewater Drain"; 20070039098, entitled "Bath Drain Closure Assembly"; 20080098517, entitled "Method and Associated Apparatus for Assembling and Testing a Plumbing System"; and 20080196161 entitled "Flexible Bathtub Waste Pipe Assembly for Bathtubs and the Like"; and 20090172877, entitled "Method and Means for Covering the Flange of a Wastewater Strainer"; and 20100037392 entitled "Cable Actuated Drain"; all of which are incorporated by reference in their entirety herein.

What is claimed is:

1. A foot-actuated drain stopper, comprising:

a cap;

a seal associated with said cap;

an adapter comprising:

a body having at least one groove, a flange extending from said body, at least one arm interconnected to at least one of said body and said flange, and a hub interconnected to said at least one arm and located generally in the center of the body;

a carrier interconnected to said hub;

wherein said adapter is adapted for insertion into a strainer that is associated with a drain port of a bathtub; and wherein said cap is operatively interconnected to said carrier, and wherein said cap is capable of a first position of use that spaces the seal away from a flange of the strainer and a second position of use that engages the seal onto the flange of the strainer.

2. The drain stopper of claim 1, wherein said carrier is interconnected to the hub with a screw, said screw being engaged onto an inner surface of said cap by way of a spring.

3. A foot-actuated drain stopper adapted for interconnection to a strainer having a flange and a hub, comprising:

a cap;

a stopper body associated with said cap;

a seal interconnected to said cap;

a carrier associated with said hub;

a ring operably associated with at least one of said cap and said stopper body, wherein said carrier is rotatably interconnected to said ring, said carrier having a groove in its outer surface and said ring having an inwardly-extending detent that is operably received within said groove wherein movement of said ring along the length of the carrier causes at least one of said ring and said carrier to rotate; and wherein said cap is capable of a first position of use that spaces the seal away from a flange of the strainer and a second position of use that engages the seal onto the flange of the strainer.

4. The drain stopper of claim 3, wherein said carrier is interconnected to the hub with a screw, said screw being engaged onto an inner surface of said cap by way of a spring.

5. The drain stopper of claim 3 wherein said groove has a path with a first portion that allows the ring to travel relative to said carrier to move said seal a first distance, said groove having a second portion that prevents said ring moving in a direction opposite from said first distance when said seal is located at said second distance, and a third portion further along said first distance that allows said ring to move relative to said carrier in a distance opposite said first distance.

6. The drain stopper of claim 3, wherein said ring is positioned between said cap and said stopper body.

7. The drain stopper of claim 6, wherein said ring is rotatably interconnected between said cap and said stopper body and said carrier is adapted to interconnect to the strainer such that movement of said stopper body rotates said ring.

8. The drain stopper of claim 6, wherein said ring is fixedly interconnected between said cap and said stopper body and said carrier is adapted to rotatably interconnected to the strainer such that movement of said stopper body rotates said carrier.

9. A foot-actuated drain stopper, comprising:

a cap;

a seal associated with said cap;

an adapter comprising:

a body having at least one groove, a flange extending from said body, at least one arm interconnected to at least one of said body and said flange, and a hub interconnected to said at least one arm and located generally in the center of the body;

a carrier interconnected to said hub;

wherein said adapter is adapted for insertion into a strainer that is associated with a drain port of a bathtub;

wherein said cap is operatively interconnected to said carrier, and wherein said cap is capable of a first position of use that spaces the seal away from a flange of the strainer and a second position of use that engages the seal onto the flange of the strainer;

wherein said cap is interconnected to said seal by way of a stopper body; and further comprising a ring operatively associated with at least one of said cap and said stopper body, wherein said carrier is rotatably interconnected to said ring, said carrier having a groove in its outer surface and said ring having an inwardly-extending detent that is operatively received within said groove wherein movement of said ring along the length of the carrier causes at least one of said ring and said carrier to rotate.

10. The drain stopper of claim 9 wherein said groove has a path with a first portion that allows the ring to travel relative to said carrier to move said seal a first direction towards said flange, said groove having a second portion that prevents said ring moving away from said flange when said seal is located at said second position of use, and said groove having a third portion that allows said ring to move relative to said carrier away from said flange.

11. The drain stopper of claim 9, wherein said ring is positioned between said cap and said stopper body.

12. The drain stopper of claim 11, wherein said ring is rotatably interconnected between said cap and said stopper body and said carrier is adapted to interconnect to the strainer such that movement of said stopper body rotates said ring.

13. The drain stopper of claim 11, wherein said ring is fixedly interconnected between said cap and said stopper body and said carrier is adapted to be rotatably interconnected to the strainer such that movement of said stopper body rotates said carrier.

* * * * *